US007231164B2

(12) United States Patent
Harada et al.

(10) Patent No.: US 7,231,164 B2
(45) Date of Patent: Jun. 12, 2007

(54) DEVELOPING UNIT, DEVELOPING CARTRIDGE, AND IMAGE FORMING APPARATUS

(75) Inventors: Kinya Harada, Susono (JP); Koji Hashimoto, Shizuoka-ken (JP); Tomonori Mori, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 234 days.

(21) Appl. No.: 10/924,771

(22) Filed: Aug. 25, 2004

(65) Prior Publication Data

US 2005/0053393 A1 Mar. 10, 2005

(30) Foreign Application Priority Data

Aug. 29, 2003 (JP) ..... 2003/308094
Aug. 20, 2004 (JP) ..... 2004/241640

(51) Int. Cl.
*G03G 15/08* (2006.01)

(52) U.S. Cl. ..... 399/106; 399/102; 399/103; 399/120

(58) Field of Classification Search ..... 399/102, 399/103, 106, 120
See application file for complete search history.

(56) References Cited

U.S. PATENT DOCUMENTS

| | | | | |
|---|---|---|---|---|
| 5,740,500 | A | 4/1998 | Hashimoto | 399/114 |
| 5,745,822 | A * | 4/1998 | Nishimura et al. | 399/106 |
| 5,923,924 | A | 7/1999 | Hashimoto | 399/111 |
| 6,016,408 | A | 1/2000 | Hashimoto et al. | 399/27 |
| 6,044,235 | A | 3/2000 | Hashimoto | 399/99 |
| 6,101,352 | A | 8/2000 | Hashimoto et al. | 399/119 |
| 6,131,011 | A | 10/2000 | Kojima et al. | 399/351 |
| 6,151,459 | A | 11/2000 | Hashimoto et al. | 399/27 |

(Continued)

FOREIGN PATENT DOCUMENTS

CN 1276543 12/2000

(Continued)

OTHER PUBLICATIONS

Oct. 31, 2006 Japanese Office Action in Japanese Application No. 2004-241640 (excerpt english translation thereof).

(Continued)

*Primary Examiner*—David M. Gray
*Assistant Examiner*—Joseph S. Wong
(74) *Attorney, Agent, or Firm*—Fitzpatrick, Cella, Harper & Scinto

(57) ABSTRACT

A developing unit detachably mountable to a main assembly of an electrophotographic image forming apparatus, includes a developing member for developing an electrostatic latent image formed on an electrophotographic photosensitive member, a developer accommodating portion accommodating developer to be used by the developing member and having a supply opening for supplying the developer to the developing member, a mover sealing member movable between supply-opening sealing and unsealing positions, a mover for moving the sealing member from the sealing to the unsealing position by receiving a driving force transmitted from the main assembly, and a memory for storing sealing information indicative of a sealed state of the supply opening. When the main assembly detects the sealing information upon mounting of the developing unit, the driving force is transmitted to the mover to move the sealing member from the sealing to the unsealing position, and then, the memory stores the unsealing information.

3 Claims, 13 Drawing Sheets

U.S. PATENT DOCUMENTS

| | | | | |
|---|---|---|---|---|
| 6,157,792 | A | 12/2000 | Mori et al. | 399/24 |
| 6,246,853 | B1 | 6/2001 | Suzuki et al. | 399/262 |
| 6,266,503 | B1 | 7/2001 | Murayama et al. | 399/117 |
| 6,298,217 | B1 | 10/2001 | Murayama et al. | 399/358 |
| 6,301,457 | B1 | 10/2001 | Chadani et al. | 399/167 |
| 6,314,266 | B1 | 11/2001 | Murayama et al. | 399/353 |
| 6,324,357 | B1 | 11/2001 | Gomi et al. | 399/50 |
| 6,404,996 | B1 | 6/2002 | Mori et al. | 399/24 |
| 6,445,893 | B2 | 9/2002 | Hashimoto et al. | 399/106 |
| 6,477,616 | B1 | 11/2002 | Takahashi | 711/111 |
| 6,496,664 | B1 | 12/2002 | Ogata et al. | 399/62 |
| 6,496,667 | B2 | 12/2002 | Shiratori et al. | 399/103 |
| 6,505,021 | B2 | 1/2003 | Shibuya et al. | 399/149 |
| 6,512,903 | B2 | 1/2003 | Chadani | 399/106 |
| 6,560,422 | B2 | 5/2003 | Kanno et al. | 399/106 |
| 6,735,403 | B2 | 5/2004 | Kanno et al. | 399/103 |
| 6,826,380 | B2 | 11/2004 | Karakama et al. | 399/111 |
| 2001/0005460 | A1* | 6/2001 | Shiratori et al. | 399/103 |
| 2002/0018668 | A1* | 2/2002 | Kanno et al. | 399/106 |
| 2002/0031368 | A1* | 3/2002 | Kanno et al. | 399/103 |
| 2003/0142994 | A1 | 7/2003 | Harada et al. | 399/111 |
| 2003/0156848 | A1 | 8/2003 | Kawai et al. | 399/27 |
| 2003/0156855 | A1 | 8/2003 | Nittani et al. | 399/106 |
| 2003/0161644 | A1* | 8/2003 | Yokoi et al. | 399/27 |
| 2004/0105698 | A1 | 6/2004 | Yamaguchi et al. | 399/109 |

FOREIGN PATENT DOCUMENTS

| | | |
|---|---|---|
| JP | 2000-235301 | 8/2000 |
| JP | 2000-305839 | 11/2000 |
| JP | 2001-154475 | 6/2001 |
| JP | 2001-305839 | 11/2001 |
| JP | 2002-365897 | 12/2002 |
| JP | 2003-195615 | 7/2003 |
| JP | 2003-223044 | 8/2003 |

OTHER PUBLICATIONS

Chinese Office Action in Chinese Application No. 200410076986.7 dated Mar. 2, 2007.

* cited by examiner

DEVELOPING UNIT, DEVELOPING CARTRIDGE, AND IMAGE FORMING APPARATUS

FIELD OF THE INVENTION AND RELATED ART

The present invention relates to a development unit, a process cartridge, and an electrophotographic image forming apparatus in which a development unit and a process cartridge are removably mountable.

Here, an electrophotographic image forming apparatus is an apparatus for forming an image on recording medium with the use of one of the electrophotographic image forming methods. As for examples of an electrophotographic image forming apparatus, there are an electrophotographic copying machine, an electrophotographic printer (for example, a laser beam printer, an LED printer, etc.), a word processor, etc.

In the field of an electrophotographic image forming apparatus employing an electrophotographic image formation process, a process cartridge system has been employed, according to which an electrophotographic photosensitive drum, and one or more of processing means, which act on the electrophotographic photosensitive drum, are integrally placed in a cartridge removably mountable in the main assembly of an electrophotographic image forming apparatus. Also according to a process cartridge system, an electrophotographic image forming apparatus can be maintained by a user himself, that is, without relying on service personnel, improving drastically the operability of the electrophotographic image forming apparatus. Thus, a process cartridge system has been widely used in the field of an electrophotographic image forming apparatus.

In an electrophotographic image forming apparatus, a beam of light from a laser, an LED, an ordinary lamp, or the like, is projected, while being modulated with image formation data, onto an electrophotographic member (which hereinafter will be referred to as a "photosensitive drum"), forming an electrophotographic image on the photosensitive drum. This electrostatic latent image is developed by a development unit integrally built in a process cartridge, into an image formed of developer (which hereinafter will be referred to as a "developer image" or a "toner image"). The developer image formed on the photosensitive drum is transferred onto a recording medium; in other words, an image is formed on a recording medium.

Ordinarily, a process cartridge removably mountable in an image forming apparatus has a developer storage portion (which hereinafter will be referred to as a "toner container") in which the developer (which hereinafter may be referred to as "toner") used by a developing member is stored. The toner container is provided with a toner outlet through which the toner therein is supplied to the developing member. Prior to the first-time usage of a toner container, the toner outlet is kept sealed by a sealing member (which hereinafter will be referred to as a "toner seal") in order to prevent the toner from flowing to the developing member. Thus, it is necessary for a user to remove the toner seal by pulling out the toner seal prior to the first-time usage of a process cartridge.

As the means for further improving an electrophotographic image forming apparatus, there has been known a structural arrangement capable of mechanically removing (winding away) the toner seal from the main assembly of an image forming apparatus, as soon as a process cartridge, the toner seal of which has not been removed, is mounted in the image forming apparatus (Japanese Laid-open Patent Application 2001-305839, U.S. Pat. Nos. 6,445,893 and 6,560,422).

However, an automatic toner seal removal system in accordance with the prior art requires a means for detecting whether or not the toner seal has been completely wound away to fully expose the toner outlet.

SUMMARY OF THE INVENTION

Thus, the primary object of the present invention is to provide a combination of a development unit, a process cartridge, and an electrophotographic image forming apparatus, capable of automatically and reliably moving the aforementioned sealing member to expose the toner outlet of a toner container.

Another object of the present invention is to provide a combination of a development unit, a process cartridge, and an electrophotographic image forming apparatus, capable of storing in the memory of the development unit or process cartridge the information that the developer outlet of the development unit is sealed with the sealing member, and therefore, capable of unsealing the developer outlet of the developer storage portion of the development unit, with the use of the driving force from the apparatus main assembly, based on the information in the memory.

Another object of the present invention is provide a combination of a development unit, a process cartridge, and an electrophotographic image forming apparatus, which requires only simple control to expose the aforementioned opening by automatically moving the aforementioned sealing member.

Another object of the present invention is to provide an electrophotographic image forming apparatus capable of minimizing the electric power consumption by transmitting a driving force for unsealing the developer outlet of the development unit, only to the development units, the opening of the developer outlet of the developer storage portion of which is sealed, or the process cartridges having such a development unit.

Another object of the present invention is to provide an electrophotographic image forming apparatus capable of preventing the service life of the development unit, or process cartridge, from being reduced by the unnecessary transmission of the driving force thereto, by transmitting a driving force for unsealing the developer outlet of the development unit, only to the development units, the opening of the developer outlet of the developer storage portion of which is sealed, or the process cartridges having such a development unit.

Another object of the present invention is to provide a combination of a development unit, a process cartridge, and an electrophotographic image forming apparatus, capable of exposing the developer outlet of the developer storage portion of the development unit by automatically moving the sealing member for sealing the developer outlet, without directly detecting the presence of the sealing member.

According to an aspect of the present invention, there is provided a developing unit detachably mountable to a main assembly of an electrophotographic image forming apparatus. The apparatus comprises a developing member for developing an electrostatic latent image formed on an electrophotographic photosensitive member, a developer accommodating portion for accommodating a developer to be used by the developing member, the developer accommodating portion having a supply opening for supplying the developer to the developing member, a sealing member movable between a sealing position in which the supply opening is sealed and an unsealing position in which the supply opening is unsealed, a sealing member moving means for moving the sealing member from the sealing position to the unsealing position to unseal the supply opening by receiving a driving force transmitted from a driving motor provided in a main assembly of the apparatus, and a memory for storing sealing information that is indicative of a sealed state of the supply opening sealed with the sealing member. When the main assembly of the apparatus detects the sealing information upon mounting of the developing unit to the main assembly of the apparatus, the driving force is transmitted to the sealing member moving means to move the sealing member from the sealing position to the unsealing position, and then, the memory stores unsealing information indicative of unsealing of the supply opening.

According to another aspect of the present invention, there is provided a process cartridge detachably mountable to a main assembly of an electrophotographic image forming apparatus. The process cartridge includes an electrophotographic photosensitive member, a developing member for developing an electrostatic latent image formed on the electrophotographic photosensitive member, a developer accommodating portion for accommodating a developer to be used by the developing member, the developer accommodating portion having a supply opening for supplying the developer to the developing member, a sealing member movable between a sealing position in which the supply opening is sealed and an unsealing position in which the supply opening is unsealed, a sealing member moving means for moving the sealing member from the sealing position to the unsealing position to unseal the supply opening by receiving a driving force transmitted from a driving motor provided in a main assembly of the apparatus, and a memory for storing sealing information indicative of a sealed state of the supply opening sealed with the sealing member. When the main assembly of the apparatus detects the sealing information upon mounting of the process cartridge to the main assembly of the apparatus, the driving force is transmitted to the sealing member moving means to move the sealing member from the sealing position to the unsealing position, and then, the memory stores unsealing information indicative of unsealing of the supply opening.

According to a further aspect of the present invention, there is provided an electrophotographic image forming apparatus to which a developing unit is detachably mountable. The apparatus comprises (i) a driving motor, and (ii) mounting means for demountable mounting a developing unit. The developing unit includes a developing member for developing an electrostatic latent image formed on an electrophotographic photosensitive member, a developer accommodating portion for accommodating a developer to be used by the developing member, the developer accommodating portion having a supply opening for supplying the developer to the developing member, a sealing member movable between a sealing position in which the supply opening is sealed and an unsealing position in which the supply opening is unsealed, a sealing member moving means for moving the sealing member from the sealing position to the unsealing position to unseal the supply opening by receiving a driving force transmitted from a driving motor provided in a main assembly of the apparatus, and a memory for storing sealing information that is indicative of a sealed state of the supply opening sealed with the sealing member. When the main assembly of the apparatus detects the sealing information upon mounting of the developing unit to the main assembly of the apparatus, the driving force is transmitted to the sealing member moving means to move the sealing member from the sealing position to the unsealing position, and then, the memory stores unsealing information indicative of unsealing of the supply opening. The apparatus further comprises (iii) control means for transmitting the driving force to the sealing member moving means to move the sealing member from the sealing position to the unsealing, thus unsealing the supply opening, and for storing in the memory unsealing information indicative of unsealing of the supply opening, when the apparatus detects the sealing information upon mounting of the developing unit to the apparatus.

According to a further aspect of the present invention, there is provided an electrophotographic image forming apparatus to which a process cartridge is detachably mountable. The apparatus comprises (i) a driving motor, and (ii) mounting means for demountably mounting a process cartridge. The process cartridge includes an electrophotographic photosensitive member, a developing member for developing an electrostatic latent image formed on the electrophotographic photosensitive member, a developer accommodating portion for accommodating a developer to be used by the developing member, the developer accommodating portion having a supply opening for supplying the developer to the developing member, a sealing member movable between a sealing position in which the supply opening is sealed and an unsealing position in which the supply opening is unsealed, a sealing member moving means for moving the sealing member from the sealing position to the unsealing position to unseal the supply opening by receiving a driving force transmitted from a driving motor provided in a main assembly of the apparatus, and a memory for storing information that is indicative of a sealed state of the supply opening sealed with the sealing member. When the main assembly of the apparatus detects the sealing information upon mounting of the process cartridge to the main assembly of the apparatus, the driving force is transmitted to the sealing member moving means to move the sealing member from the sealing position to the unsealing position, and then, the memory stores unsealing information indicative of unsealing of the supply opening. The apparatus further comprises (iii) control means for transmitting the driving force to the sealing member moving means to move the sealing member from the sealing position to the unsealing, thus unsealing the supply opening, and for storing in the memory unsealing information indicative of unsealing of the supply opening, when the apparatus detects the sealing information upon mounting of the process cartridge to the apparatus.

According to a further aspect of the present invention, there is provided an electrophotographic image forming apparatus to which a plurality of developing unit are detachably mountable. The apparatus comprises (i) a driving motor, and (ii) mounting means for demountable mounting developing units. The developing units each include a developing member for developing an electrostatic latent image formed on an electrophotographic photosensitive member, a developer accommodating portion for accommodating a developer to be used by the developing member, the developer accommodating portion having a supply opening for supplying the developer to the developing member, a sealing member movable between a sealing position in which the supply opening is sealed and an unsealing position in which the supply opening is unsealed, and a sealing member moving means for moving the sealing member from the sealing position to the unsealing position to unseal the supply opening by receiving a driving force transmitted from a driving motor provided in a main assembly of the apparatus. The apparatus further comprises (iii) control means for transmitting the driving force to the sealing member moving means of only the developing unit for which the sealing position of the sealing member is detected to move the sealing member from the sealing position to the unsealing position, when the plurality of developing units are mounted to the apparatus.

According to a further aspect of the present invention, there is provided an electrophotographic image forming apparatus to which a plurality of process cartridges are detachably mountable. The apparatus comprises (i) a driving motor, and (ii) mounting means for demountable mounting process cartridges. The process cartridges each include a developing member for developing an electrostatic latent image formed on an electrophotographic photosensitive member, a developer accommodating portion for accommodating a developer to be used by the developing member, the developer accommodating portion having a supply opening for supplying the developer to the developing member, a sealing member movable between a sealing position in which the supply opening is sealed and an unsealing position in which the supply opening is unsealed, and a sealing member moving means for moving the sealing member from the sealing position to the unsealing position to unseal the supply opening by receiving a driving force transmitted from a driving motor provided in a main assembly of the apparatus. The apparatus further comprises (iii) control means for transmitting the driving force to the sealing member moving means of only the process cartridge for which the sealing position of the sealing member is detected to move the sealing member from the sealing position to the unsealing position, when the plurality of process cartridges are mounted to the apparatus.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the development unit, process cartridge, and electrophotographic image forming apparatus, in accordance with the present invention will be described in detail.

Embodiment 1

Figure 1:
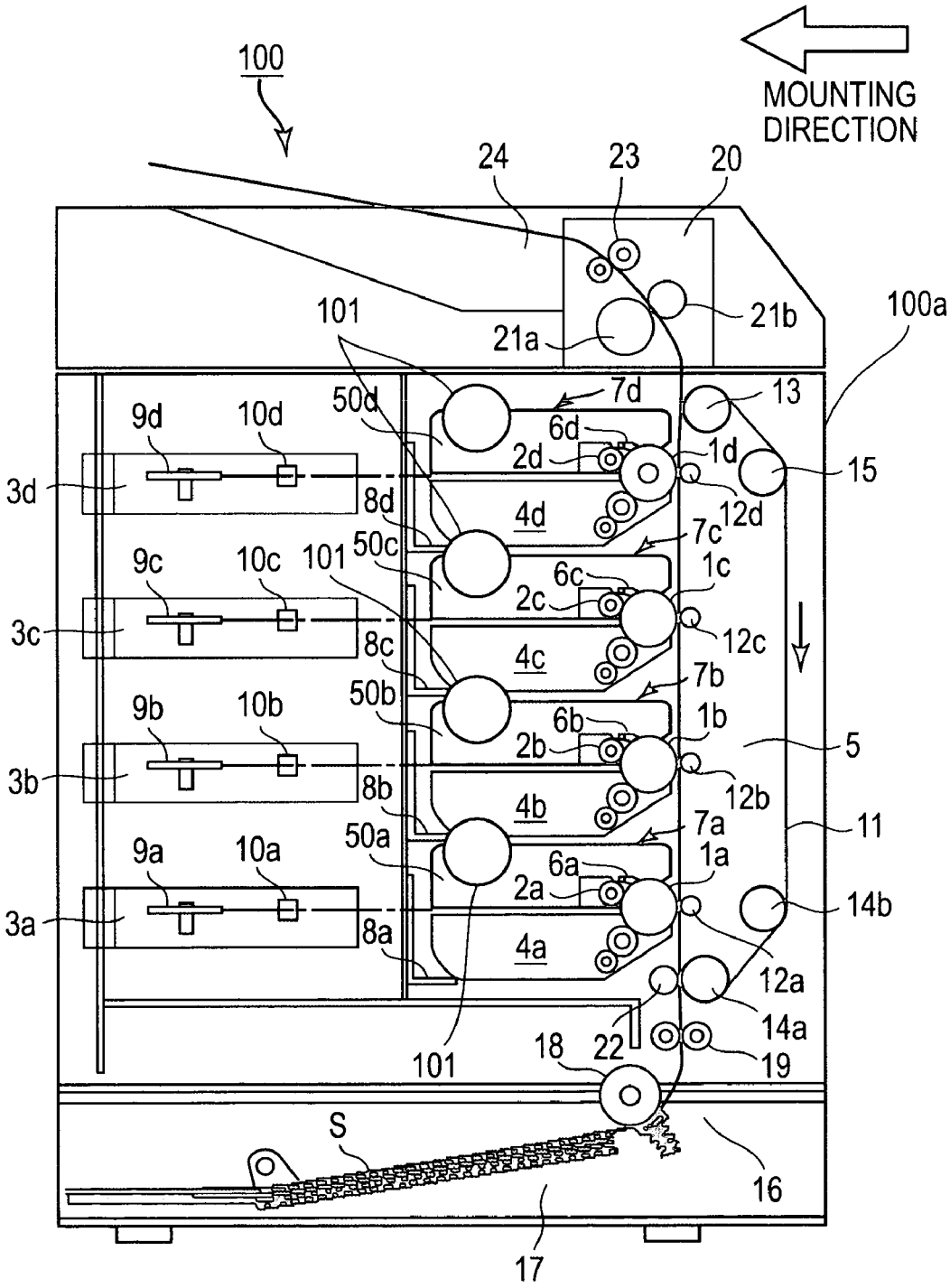
FIG. 1 is a schematic sectional view of the electrophotographic image forming apparatus in the first embodiment of the present invention, showing the general structure thereof.

FIG. 1 is a schematic sectional view of the electrophotographic image forming apparatus, more specifically, an electrophotographic color image forming apparatus, in the first embodiment of the present invention, showing the general structure thereof. First, the general structure of the electrophotographic color image forming apparatus will be described.

(General Structure of Image Forming Apparatus)

Referring to FIG. 1, the electrophotographic color image forming apparatus 100 has four process cartridge compartments (8*a*, 8*b*, 8*c*, and 8*d*) in which four cartridges 7 (7*a*, 7*b*, 7*c*, and 7*d*) are mounted one for one. The four process cartridge compartments are vertically stacked in parallel. Each of the four cartridges 7 in their own cartridge compartments comprises an electrophotographic photosensitive drum 1 (1*a*, 1*b*, 1*c*, and 1*d*), which is rotationally driven in the counterclockwise direction (indicated by arrow mark X in FIG. 2) by a driving means (FIG. 3).

In the adjacencies of the peripheral surface of the photosensitive drum 1, a charging means 2 (2*a*, 2*b*, 2*c*, and 2*d*) for uniformly charging the peripheral surface of the photosensitive drum 1, a scanner unit (3*a*, 3*b*, 3*c*, and 3*d*) for forming an electrostatic latent image on the peripheral surface of the photosensitive drum 1, by exposing the peripheral surface of the photosensitive drum 1 to a beam of laser light modulated with image formation data, a development unit 4 (4*a*, 4*b*, 4*c*, and 4*d*) for forming a toner image with the use of toner as developer, an electrostatic transferring means (12*a*, 12*b*, 12*c*, and 12*d*) for transferring the toner image on the photosensitive drum 1 onto a recording medium S, and a cleaning means (6*a*, 6*b*, 6*c*, and 6*d*) for removing the toner remaining on the peripheral surface of the photosensitive drum 1 after the transfer, are located in the listed order.

In this embodiment, the photosensitive drum 1, the charging means 2, the development unit 4, and the cleaning means are integrally placed in a cartridge, making up a process cartridge 7.

The photosensitive drum 1 comprises an aluminum cylinder, for example, with a diameter of 30 mm, and a layer of organic photoconductor coated on the peripheral surface of the aluminum cylinder. The photosensitive drum 1 is rotatably supported by a pair of supporting members (unshown), by the lengthwise ends thereof. Referring to FIG. 3, the photosensitive drum 1 is provided with a drum gear 114, which is attached to one of the lengthwise ends of the photosensitive drum 1, and to which a driving force is transmitted from a motor 101 through a gear train (comprising gears 103*a*, 103*b*, and 104), rotationally driving the photosensitive drum 1 in the counterclockwise direction (direction indicated by arrow mark X in FIG. 2).

Figure 2:
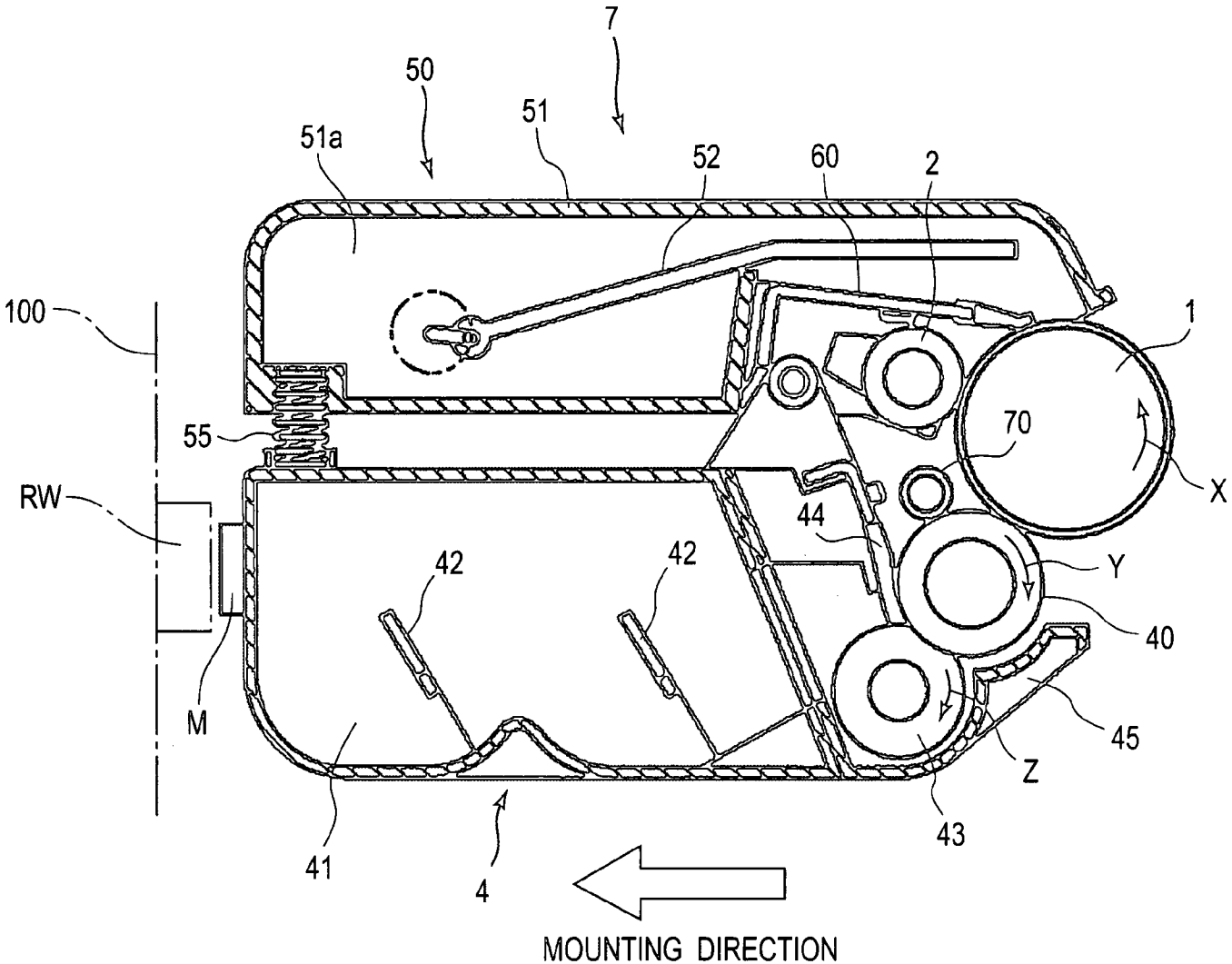
FIG. 2 is a schematic sectional view of the process cartridge in the first embodiment, showing the general structure thereof.
Figure 3:
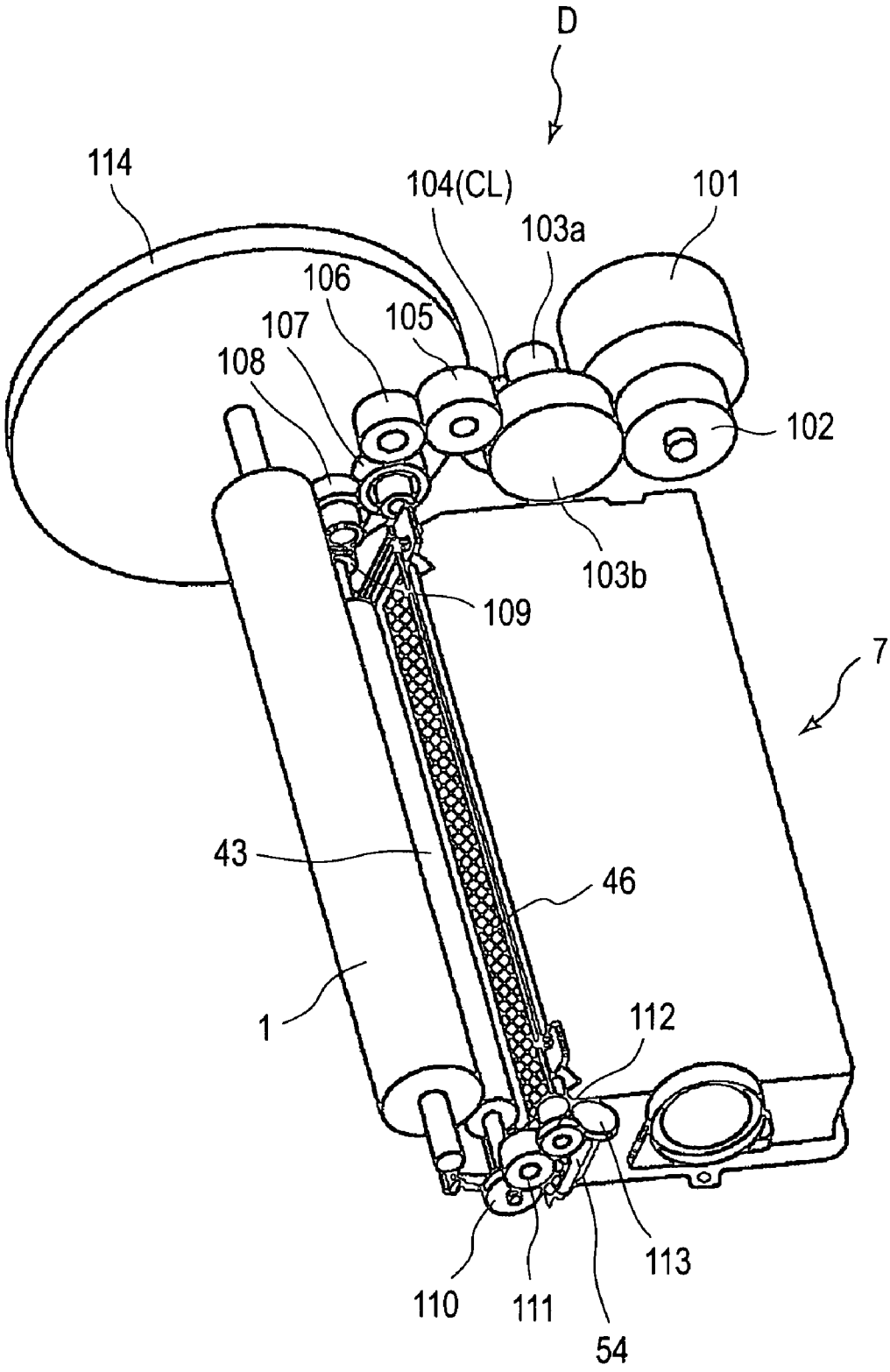
FIG. 3 is a perspective view depicting the driving means of the process cartridge.

Referring to FIG. 2, the charging means 2 (2*a*, 2*b*, 2*c*, and 2*d*) in this embodiment is of one of the contact types. The charging member 2 as a charging means is an electrically conductive roller, which is placed in contact with the peripheral surface of the photosensitive drum 1. As charge bias (voltage) is applied to this roller 2, the peripheral surface of the photosensitive drum 1 is uniformly charged.

The scanner unit (3*a*–3*d*) is positioned at virtually the same level as the photosensitive drum 1. In operation, a beam of image forming light is projected, while being modulated with the video signals, by a laser diode (unshown) toward a polygon mirror (9*a*, 9*b*, 9*c*, and 9*d*), being deflected (reflected) by the polygon mirror. The deflected beam of image formation light is focused on the peripheral surface of the photosensitive drum 1 through a set of focusing lenses (10*a*, 10*b*, 10*c*, and 10*d*), selectively exposing numerous points of the uniformly charged peripheral surface of the photosensitive drum 1. As a result, an electrostatic latent image in accordance with the video signals, is formed on the peripheral surface of the photosensitive drum 1.

Also referring to FIG. 2, the development unit 4 (4*a*, 4*b*, 4*c*, and 4*d*) comprises a developer (toner) storage portion for storing developer (toner), that is, a toner container 41, and a developing means container 45, that is, a frame which supports the developing means.

More specifically, the yellow development unit 4*a*, the magenta development unit 4*b*, the cyan development unit 4*c*, and the black development unit 4*d* have toner containers in which yellow, magenta, cyan, and black toners are contained, respectively.

In each toner container 41, a development roller 40, on the peripheral surface of which developer is carried, is placed so that the peripheral surfaces of the development roller 40 and the photosensitive drum 1 remain in contact, or virtually in contact, with each other.

Again referring to FIG. 2, the toner within the toner container 41 is sent to a toner supply roller 43 by a toner conveying and the stirring member 42, is carried on the peripheral surface of the toner supply roller 40, and is coated across the peripheral surface of the development roller 40 by a development blade 44 kept pressed upon the peripheral surface of the development roller 40. While the developer is coated on the peripheral surface of the development roller 40, it is given an electric charge. Then, as development bias is applied to the development roller 40, the electrostatic latent image on the peripheral surface of the photosensitive drum 1 is developed into a visible image, that is, an image formed of toner.

Referring to FIG. 1, the image forming apparatus 100 is provided with an electrostatic transfer belt 11, which is vertically extended so that it contacts all of the photosensitive drums 1. The electrostatic static transfer belt 11 is circularly moved in contact with the peripheral surfaces of the photosensitive drums 1. The transfer belt 11 is formed of film, which is roughly 150 μm in thickness, and the volume specific resistance of which is in the range of $10^{11}$–$10^{14}$ Ωcm. The recording medium S is conveyed by the transfer belt 11 to the transfer station, in which the toner image on the photosensitive drum 1 is transferred onto the recording medium S.

The transfer belt 11 is stretched around four rollers, which are a driver roller 13, follower rollers 14*a* and 14*b*, and tension roller 15, and is circularly driven in the direction indicated by an arrow mark in FIG. 1, conveying therefore the recording medium S from the follower roller 14*a* side to the driver roller 13 side. As the transfer belt 11 is driven in a circulatory fashion, the toner image on the photosensitive drum 1 is transferred onto the recording medium S.

Placed in parallel in contact with the inwardly facing surface, in terms of the loop formed by the transfer belt 11, of the transfer belt 11 are four transfer rollers (12*a*, 12*b*, 12*c*, and 12*d*), as transferring means, being kept pressed against the four photosensitive drums 1 (1*a*, 1*b*, 1*c*, and 1*d*), with the transfer belt 11 kept pinched between the photosensitive drums 1 and transfer rollers, respectively. From these transfer rollers, positive electric charge is applied to the recording medium S through the transfer belt 11. As a result, the toner images on the photosensitive drums 1 are transferred onto the recording medium S.

A recording medium feeding portion 16 is a portion from which one or more recording media S are conveyed to the image formation stations. The recording medium feeding portion 16 has a feeder cassette 17 in which a certain number of recording media S are stored. In an image forming operation, the feeder roller 18 and a pair of registration rollers 19 are rotationally driven in synchronism with the progression of the image forming operation, feeding the recording media S one by one from the cassette 17, into the main assembly of the image forming apparatus. Each recording medium S is temporarily held up by the pair of registration rollers 19, as the leading edge of the recording medium S comes into contact with the pair of rollers 19. The recording medium S held up by the pair of registration rollers 19 is released by the pair of registration rollers 19 in synchronism with the rotation of the transfer belt 11 and the progression of the toner image formation; it is conveyed to the transfer belt 11.

The fixation station 20 is the station in which the two or more toner images having just been transferred onto the recording medium S are fixed to the recording medium S. The fixation station 20 has a rotational heat roller 21*a*, and a rotational pressure roller 21*b* kept pressed upon the heat roller 21*a*. In operation, the recording medium S onto which a single or more toner images have been transferred from the peripheral surfaces of the photosensitive drums 1, is conveyed through the fixation station 20, while remaining pinched between the pair of fixation rollers (21*a* and 21*b*) and being given heat and pressure by the pair of fixation rollers. As a result, images different in color are fixed to the surface of the recording medium S.

The image forming operation of the image forming apparatus in this embodiment is as follows.

First, the process cartridges 7 (7*a*, 7*b*, 7*c*, and 7*d*) are sequentially rotated in synchronism with the progression of an image forming operation, causing the photosensitive drums 1 (1*a*, 1*b*, 1*c*, and 1*d*) to rotate. Further, as the process cartridges 7 are driven, the scanner units (3*a*, 3*b*, 3*c*, and 3*d*), which correspond one for one to the cartridges 7, are sequentially driven, and the charging means 2 (2*a*, 2*b*, 2*c*, and 2*d*) uniformly charge the peripheral surfaces of the photosensitive drums 1, respectively. The scanner units project a beam of light, while modulating it with video signals, onto the peripheral surfaces of the photosensitive drums 1, forming electrostatic latent images on the peripheral surfaces of the photosensitive drums 1, one for one. The development rollers 40 develop the electrostatic latent images, one for one.

As described before, to the recording medium S, the toner images on the photosensitive drums 1 are sequentially transferred by the electric field formed between the photosensitive drums 1 and transfer rollers, respectively. After the transfer of the four toner images different in color, the recording medium S is separated from the transfer belt 11 by the curvature of the driving roller 13, and is conveyed into the fixation station 20. In the fixation station, the toner images are thermally fixed to the recording medium S. Thereafter, the recording medium S is discharged from the main assembly of the image forming apparatus by a pair of discharge rollers 23 through a recording medium outlet 24.

(Process Cartridge)

Next, referring to FIG. 2, the cartridge 7 (7*a*, 7*b*, 7*c*, and 7*d*) in accordance with the present invention will be described. FIG. 2 is a schematic sectional view of one the cartridges 7 which store toner, at a plane perpendicular to the lengthwise direction of thereof.

Incidentally, in this embodiment, the cartridge 7*a* storing the yellow toner, the cartridge 7*b* storing magenta toner, the cartridge 7*c* storing cyan toner, and the cartridge 7*d* storing the black toner, are identical in structure.

Each cartridge 7 is separable into the photosensitive drum unit 50 as a first frame, and the development unit 4 as a second frame. The photosensitive drum unit 50 comprises the photosensitive drum 1, the charging means 2, and the cleaning means, whereas the development unit 4 comprises a developing means.

In the photosensitive drum unit 50, the photosensitive drum 1 is rotatably supported by the cleaning means frame 51, with the interposition of a pair of bearings between the photosensitive drum 1 and the frame 51. In the adjacencies of the peripheral surface of the photosensitive drum 1, the primary charging means 2 for uniformly charging the peripheral surface of the photosensitive drum 1, and a cleaning blade 60 for removing the residual developer (toner), that is, the developer (toner) remaining on the peripheral surface of the photosensitive drum 1, are located in contact with the peripheral surface of the photosensitive drum 1, as described before. After being removed from the peripheral surface of the photosensitive drum 1 by the blade 60, the residual developer (toner) is continuously sent by the toner conveyance mechanism 52 into the waste toner chamber 51*a* located in the rear portion of the cleaning means frame. The photosensitive drum 1 is rotationally driven in the direction (counterclockwise) indicated by an arrow mark X in the drawing, in synchronism with the progression of the image forming operation, by transmitting thereto the driving force of a motor 101 (FIG. 3) located in one of the rear end corners. The image forming apparatus in this embodiment is provided with four motors in order to individually drive the cartridges 7 (7*a*, 7*b*, 7*c*, and 7*d*) as shown in FIG. 1.

At this time, referring to FIG. 3, the driving force transmitting means D of the cartridge 7 will be described.

In this embodiment, the driving force from one of the motors 101 of the apparatus main assembly 100 is transmitted from the driver gear 102 to the step gears (103*a* and 103*b*), by which the driving force is divided into two forces: a force transmitted to the gear 104 on the photosensitive drum side by the step gear 103*a*, and a force transmitted to a gear 105 on the developer container side by the step gear 103*b*.

After being transmitted to the gear 105 on the development container side, the driving force is transmitted through gears 106 and 107, and step gears 108 and 109, in the listed order, and drives the toner supply roller 43. After driving the toner supply roller 43, the driving force drives the gear 110 attached to the opposite lengthwise end of the toner supply roller shaft, and then, is transmitted to a gear 113 from the gear 110 through a gear 111 and a worm gear 112. The development roller 40 is connected to the step gear 108 by one of the end portions of its shaft (unshown), so that the driving force is transmitted to the development roller 40 through the step gear 108.

To describe this process in more detail, the gear 113 is an integral part of a shaft 54 for winding up a sealing member 46, which will be described later. Thus, as the driving force is transmitted to the gear 113, it is transmitted to the sealing member winding shaft 54 integral with the gear 113.

As for the portion of the driving force transmitted to the gear 104 on the photosensitive drum side through the step gear 103*a* as described above, it is transmitted from the gear 104 to the gear 114, driving therefore, the photosensitive drum 1.

Referring to FIG. 2, the development unit 4 comprises: the development roller 40 as a developer carrying member, which is rotated in contact with the photosensitive drum 1, in the direction indicated by an arrow mark Y; a developing means container 45 (developing means frame) in which the development roller 40 is disposed; and a toner container 41 in which toner is stored.

The development roller 40 is rotatably supported by the developing means container 45. In the adjacencies of the development roller 40, the toner supply roller 43 as a developer supplying member, which is rotated in contact with the development roller 40, in the direction indicated by an arrow mark Z, and the development blade 44 as a developer regulating member, are located. Further, the toner container 41 contains the member 42 (which hereinafter will be referred to as toner conveying-stirring member) for conveying toner, while stirring it, to the toner supply roller 43.

While the development process is carried out, the toner in the toner container 41 is conveyed to the toner supply roller 43 by the toner conveying-stirring member 42, and is borne on the peripheral surface of the toner supply roller 43, which is being rotated in the direction indicated by the arrow mark, in contact with the development roller 40 which is being rotated in the direction indicated by the arrow mark. As a result, the layer of the toner on the peripheral surface of the toner supply roller 43 is rubbed by the peripheral surface of the development roller 40, being thereby supplied (transferred) onto the peripheral surface of the development roller 40. The layer of toner on the peripheral surface of the development roller 40 is moved past the development blade 44 by the rotation of the development roller 40. As the layer of toner is moved past the development blade 44, it is regulated in thickness, being thereby formed into a thinner layer of toner with a predetermined thickness, which is uniform in thickness. Then, this thin layer of toner, which is uniform in thickness, is brought by the further rotation of the development roller 40 to the charge roller 70 as a developer charging means, by which it is given a predetermined amount of electric charge.

Then, the thin layer of toner on the peripheral surface of the development roller 40 is conveyed to the development station, that is, the contact area between the peripheral surfaces of the photosensitive drum 1 and development roller 40, by the further rotation of the development roller 40. In the development station, the toner particles in the thin layer of toner are adhered to the electrostatic latent image on the peripheral surface of the photosensitive drum 1, by the development bias (DC voltage) applied to the development roller 40 from an unshown electrical power source; in other words, the latent image is developed. The residual toner, or the toner remaining on the peripheral surface of the development roller 40 after the development, is returned to the developing means container 45 by the further rotation of the development roller 40. In the developing means container 45, the residual toner on the peripheral surface of the development roller 40 is rubbed off the peripheral surface of the development roller 40 by the peripheral surface of the toner supply roller 43, at the upstream edge of the contact area between the toner supply roller 43 and development roller 40, in terms of the rotational direction of the development roller 40, and recovered into the developing means container 45. The recovered toner is mixed into the toner in the developing means container, by the toner conveying-stirring member 42.

Referring to FIGS. 1 and 2, the cartridge 7 is inserted into the main assembly 100 of the image forming apparatus in the direction indicated by an arrow mark, along a pair of cartridge guides (unshown) of the apparatus main assembly 100, until the cartridge 7 settles into the predetermined position.

Next, referring to FIGS. 4–11, the portions of the image forming apparatus, which are related to the gist of the present invention, more specifically, the sealing member 46 for sealing the developer (toner) outlet 41*a* of the development unit 4, and the structural arrangement for winding up the sealing member 46 in order to retract the sealing member 46 to unseal the developer outlet 41*a*, will be described along with the operational sequence therefor.

(Means for Moving Sealing Member)

Figure 4:
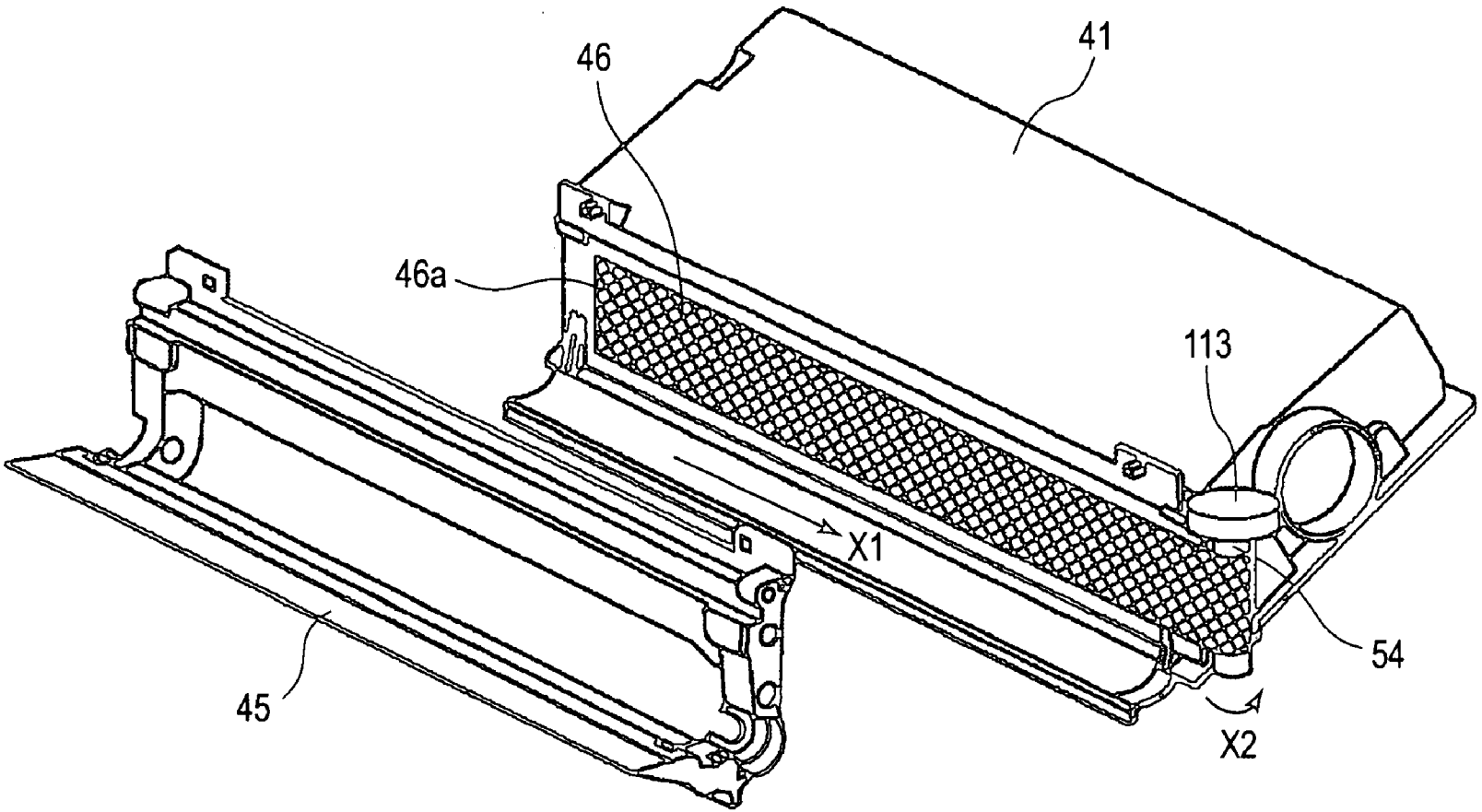
FIG. 4 is a perspective view of the development unit of the process cartridge, showing the general structure thereof.

FIG. 4 depicts the toner container 41 and the developing means container 45. As will be evident from FIG. 4, there is an opening 41*a* between the toner container and the developing means container 45. The toner in the toner container 41 is sent out from the toner container 41 into the developing means container 45 through this opening 41*a*. Prior to the first-time usage of the cartridge 7, the opening 41*a* is surrounded by a toner seal seat 41*b* to which the toner seal 46, as a sealing member, is welded. The toner seal 46 will be described later in detail.

Figure 5:
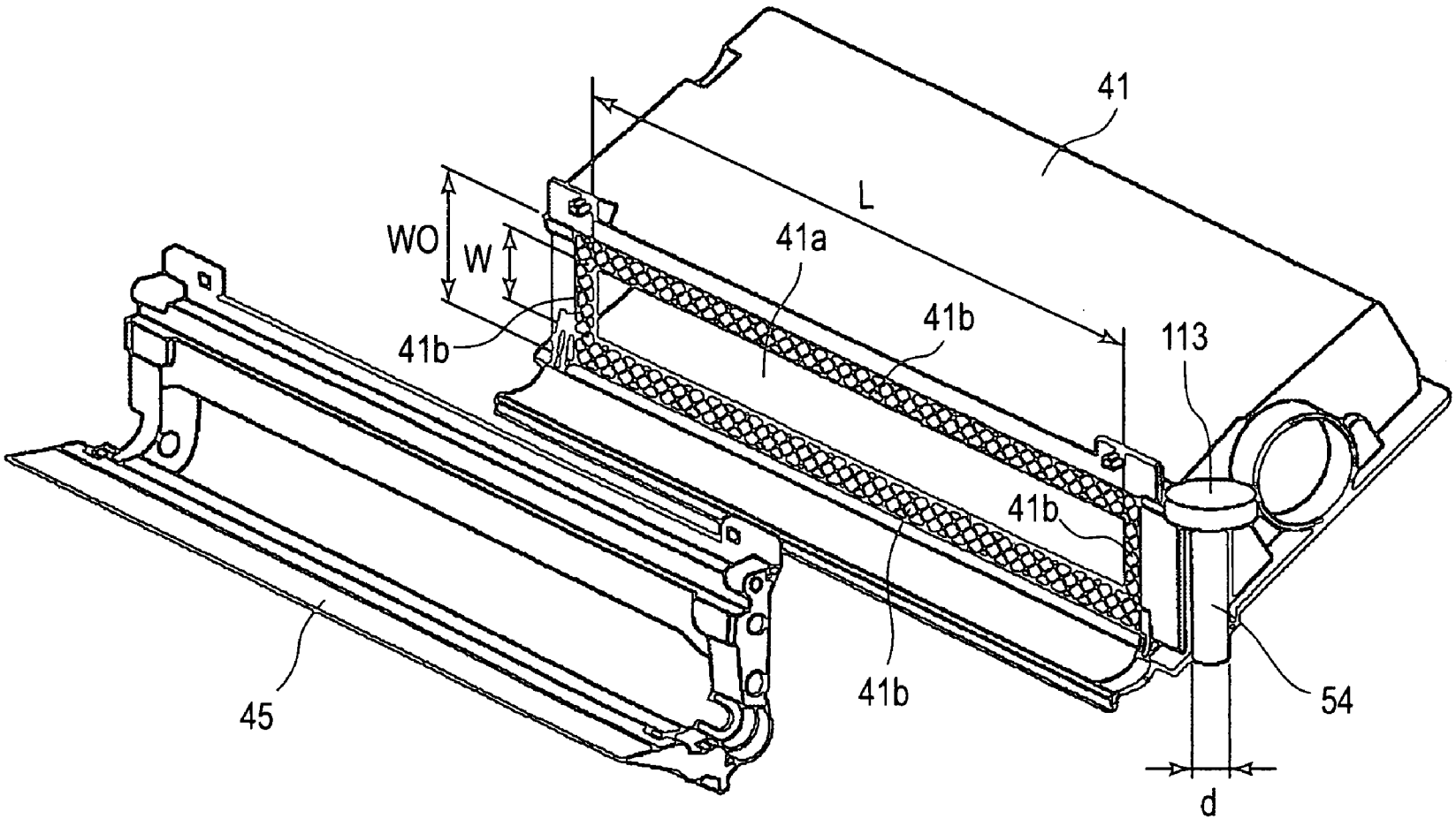
FIG. 5 is a perspective view of the development unit of the process cartridge, showing the general structure thereof.

FIGS. 4 and 5 depict the developing means container 45, and the toner seal 46 welded (adhered) to the toner seal seat 41*b* of the toner container 41. The toner seal 46 is a long rectangular sheet formed of a predetermined substance. It is welded or glued to the toner seal seat 41*b* (FIG. 5), sealing thereby the opening 41*a* (sealing position).

More specifically, the toner seal 46 is extended from one of the lengthwise ends of the opening 41*a* to the other end 46*a*, is folded back at the end 46*a*, is extended all the way back to the first end, where it is attached to the seal winding shaft 54 as a means for removing the toner seal 46, with the use of an unshown adhering means. The opening 41*a* can be exposed by pulling the toner seal 46 in the direction indicated by an arrow mark X1 (toner container is open); the toner seal 46 can be peeled away (opening 41*a* can be exposed) by rotating the winding shaft 54 in the direction indicated by an arrow mark X2. The toner seal winding shaft 54 is driven in the following manner.

First, as described with reference to FIG. 3, the driving force from the motor 101, as driving means D, of the image forming apparatus main assembly 101 is transmitted to the development roller 40, the toner supply roller 43, and the toner conveying-stirring member 42 in the development unit 4 of the cartridge 7, through the aforementioned gear train.

This driving force is transmitted to the other lengthwise end of the cartridge 7 through the toner supply roller 43 in order to drive the toner seal winding shaft 54 as the sealing member removing means. Structuring the power transmission system as described above makes it unnecessary to provide the image forming apparatus with a power source dedicated to remove the toner seal 46; in other words, not only can it simplify in structure the mechanism for driving the process cartridge 7, but also, it can reduce the size of the process cartridge 7.

As for the type of the toner seal 46, there is a tear tape type toner seal, in addition to an easy peel type, such as the above-described one in this embodiment, which is formed by folding a single piece of cover film. A tear tape type toner seal is a combination of a cover film and a tear tape for tearing the cover film. The present invention is also compatible with a toner seal 46 of a tear tape type, which is obvious.

The sealing member, in this embodiment, for sealing the opening 41*a* of the toner outlet of the toner container 41 is the sealing member 46, which is a long rectangular piece of film. However, the member for sealing the opening 41*a* of the toner container 41 may be in the form of a piece of plate. When a piece of plate is used as the sealing member, a structural arrangement is made so that the opening 41*a* of the toner container 41 can be exposed by sliding the sealing member in the lengthwise direction (axial direction of photosensitive drum 1) of the cartridge 7, that is, in the widthwise direction of the cartridge 7.

(General Structure of Operational System of Image Forming Apparatus)

Next, referring to FIG. 6, which is a block diagram, the operational system of the image forming apparatus in this embodiment will be described.

The engine controller 61, which controls the overall operational system of the image forming apparatus, contains an unshown central processor unit (CPU). The sequential image formation steps of the image forming apparatus are controlled by the engine control controller 61, based on the programs stored in advance in the CPU. The high voltage power source 62 applies to the charging means 2, the development bias which is a combination of DC and AC voltages, and applies to the transferring means, a transfer bias, which is DC voltage. Further, the high voltage power source 62 generates a fixation bias, that is, a DC voltage to be applied to the fixing means 20. The image forming apparatus is provided with a group of sensors 63, which are distributed throughout the apparatus. The image forming apparatus is also provided with a display portion 64 for displaying the apparatus conditions, an information processing means 65 for processing the information obtained from the storage means M in the cartridge 7, and a driving portion 66 inclusive of the above-described driving means D.

(Storage Means and Information Processing Means)

The storage means M in the cartridge 7 is, for example, an information storage unit. The information processing means 65 in the main assembly 100*a* of the image forming apparatus is, for example, a storage means control circuit. The storage unit M contains a nonvolatile memory element, being enabled to exchange image formation data with the apparatus main assembly 100*a*; image formation data can be written into, or read from, the storage unit M.

The data communication is entirely controlled by the memory control circuit (information processing means 65).

The data are exchanged between the storage unit M and the reading/writing apparatus RW, as a communicating means of the image forming apparatus main assembly 100*a*, through the internal antenna of the storage unit M. As the cartridge 7 is inserted into the image forming apparatus main assembly 100*a*, the antenna portion of the storage unit M is placed in the adjacencies of the reading/writing apparatus RW in the image forming apparatus, making it possible for the reading/writing apparatus RW to communicate with the storage unit M (FIG. 2).

The storage unit M is provided with a power source circuit, which supplies the storage unit M with the entirety of the DC power consumed by the storage unit M. The power source circuit generates DC voltage by rectifying the electric current induced in the antenna of the storage unit M by the magnetic coupling between the antenna of the storage unit M and the antenna on the main assembly side. In the memory unit M, the information regarding the cartridge 7 is stored.

When there is the information, in the storage unit M, that the cartridge 7 is brand-new, the sealing member 46 is retracted by the driving force from the image forming apparatus main assembly 100*a*, from the position in which it has kept sealed the opening 41*a* of the toner container 41, so that the opening 41*a* is exposed. As the opening 41*a* is exposed by the retraction of the sealing member 46 from the position in which the sealing member 46 has kept the opening 41*a* sealed, the information that the opening 41*a* is exposed is stored in the storage unit M.

The storage means for the cartridge 7 does not need to be the above-described storage unit M. For example, the information that the opening 41*a* is sealed or exposed may be created by providing the external surface of the cartridge 7 with a simple breakable projection (unshown). In other words, the presence of the projection enables the information processing means 65 to recognize that the opening 41*a* of the toner container 41 is sealed with the sealing member 46. On the other hand, the absence of this projection, which occurs as it is broken off by the driving force transmitted from the image forming apparatus main assembly 100*a*, at the end of the operational step in which the opening of 41*a* of the toner container 41 is exposed.

(Sealing Member Retraction Sequence)

As soon as the mounting of the cartridge 7 into the image forming apparatus main assembly 100*a* ends, the reading/writing apparatus RW begins to read the information stored in the storage means M. Then, as it is recognized by the information processing means 65 of the image forming apparatus main assembly 100*a* that the cartridge in the brand-new condition has just been mounted into the image forming apparatus main assembly 100*a*, the aforementioned engine controller 61 begins to control the apparatus main assembly 100*a* so that the driving force is transmitted from the driving means D to the cartridge 7 to expose the opening 41*a* of the toner container 41. The information, stored in the storage means M, that the cartridge 7 is in the brand-new condition may be such information that the sealing member 46 is in the position in which it keeps the opening 41*a* sealed; the sealing member 46 is in the position in which it is prior to its removal; the cartridge 7 is brand-new; or the cartridge 7 has never been used. This information that the cartridge 7 is in the brand-new condition is written into the storage means M in advance, for example, when the cartridge 7 is shipped out of a factory.

The driving force from the motor 101 of the image forming apparatus main assembly 100*a* is transmitted through a gear train to a clutch CL104, for example, an electromagnetic clutch, which is controlled by the engine controller 61 of the image forming apparatus main assembly 100*a* so that the driving force is transmitted downstream to the downstream gear train and the cartridge 7, or the driving force is not transmitted downstream, that is, the motor 100 is idled.

The clutching mechanism CL is a part of the gear assembly 104. It is engaged to allow the driving force to be transmitted to the photosensitive drum 1, or disengaged to prevent the driving force from being transmitted to the photosensitive drum 1. The clutch CL104 is provided for the following reason. That is, it is desired that the four developing means receive, at different points in time, the driving force transmitted from the motor 101 of the image forming apparatus toward the developing means container side so that the developing means in the four developing units 4 can be driven at different points in time, whereas, the photosensitive drums 1 (1*a*, 1*b*, 1*c*, and 1*d*) simultaneously receive the driving force transmitted from the motor 101 toward the photosensitive drum side so that the four photosensitive drums 1 are simultaneously driven. The reason why the four photosensitive drum must be simultaneously driven is as follows. That is, the four photosensitive drums 1 (1*a*, 1*b*, 1*c*, and 1*d*) are kept in contact with the electrostatic transfer belt 11. Therefore, if the photosensitive drums 1 are driven while the electrostatic transfer belt 11 is not driven, there is the possibility that the surface of the electrostatic transfer belt 11 will be damaged as it is rubbed by the photosensitive drums 1. In order to prevent this problem, the electrostatic transfer belt 11 also has to be driven at the same time the photosensitive drums 1 are driven. For the same reason, all the photosensitive drums 1 which are for forming the toner images different in color, one for one, and are in contact with the electrostatic transfer belt 11, must be simultaneously driven.

With the provision of the above-described mechanical arrangement, the opening 41*a* of the toner container 41 is automatically exposed as the driving force from the motor 101 of the image forming apparatus main assembly 100*a* is transmitted to the cartridge 7.

In particular, with the provision of the storage means M, information processing means 65, and the clutch CL, it is assured that after the mounting of the cartridge 7 into the apparatus main assembly 100*a*, the driving force from the motor 101 is transmitted to the developing means container side of the cartridge 7 only when the mounted cartridge 7 is in the brand-new condition.

Next, referring to the flowchart in FIG. 7, the operational sequence for transmitting the driving force only to the cartridge 7 in the brand-new condition, after the insertion of the cartridge 7 into the image forming apparatus main assembly 100*a*, will be described.

First, as the cartridge 7 is mounted into the image forming apparatus main assembly 100*a* (S1), the information processing means 65 of the image forming apparatus main assembly 100*a* reads the information in the storage means M attached to the cartridge 7 (S2). Then, based on the information read from the storage means M, the information processing means 65 determines whether or not the mounted cartridge 7 is in the brand-new condition (S3). If the cartridge 7 is not in the brand-new condition, that is, if the answer is "NO", the image forming apparatus 100 is immediately readied for image formation (S8).

On the other hand, if it is determined in Step S3 that one of the cartridges 7 is in the brand-new condition, that is, the answer is "YES", the driving force transmission path for transmitting the driving force from the image forming apparatus main assembly 100*a* only to this cartridge 7 is selected through the engine controller 61 (controlling means) (S4). In other words, the motor 101 as a driving force source is controlled by the engine controller 61 so that the driving force is transmitted only to the cartridge in the brand-new condition. As the driving force is transmitted to the cartridge 7 in the brand-new condition, the driving force is transmitted to the gear train of the cartridge 7. Then, the driving force is transmitted through the gear train and the toner supply roller 43 to the sealing member winding shaft 54 (S5). The transmission of the driving force to the winding shaft 45 is continued for a predetermined length of time, that is, long enough to wind up the toner seal 46 so that the opening 41*a* of the toner container 41 becomes fully exposed, and then, is stopped (S6). In this embodiment, the transmission of the driving force to the cartridge 7 and the cessation of the transmission of the driving force to the cartridge 7 are done by the rotation of the motor 101 and the cessation of the rotation of the motor 101, respectively. After the opening 41*a* is fully exposed, the information that the opening 41*a* of the toner container 41 has been fully exposed (in exposed condition) is written in the storage means M by the reading/writing apparatus RW (S7). Then, it is reconfirmed whether or not the cartridge 7 is in the brand-new condition (S3), and if the answer is "NO", the image forming apparatus 100 is immediately readied for image formation (S8).

In other words, this embodiment does not require a detecting means dedicated to the detection of the presence of the toner seal 46; all that is necessary is to read the information in the storage means M. Therefore, it is possible to realize an automatic toner winding mechanism which is simple to control. Incidentally, the aforementioned predetermined length of time is the length of time necessary for moving the toner seal 46 from the opening sealing position to the opening exposing position. Precisely speaking, the opening exposing position of the toner seal 46 is the position in which the toner seal 46 completely exposes the opening 41*a* of the toner container 41, whereas the opening sealing position of the toner seal 46 is the position other than the opening exposing position.

With the employment of the above-described controlling method, it is assured that even if the winding of the toner seal 46 is interrupted because of the occurrence of an unexpected situation, the toner seal 46 is moved to the opening exposing position as soon as the image forming apparatus 100 is restarted. The abovementioned unexpected situation may be such a situation that the hinged door (unshown) of the image forming apparatus 100 becomes open during an image forming operation, a power failure, or the like.

When the storage means M is a memory unit, such information as that described above is stored in the memory unit, whereas when the storage means M is the aforementioned projection in the form of a claw or the like, the same effect as storing the information in the memory unit can be realized by breaking off the claw.

Figure 7:
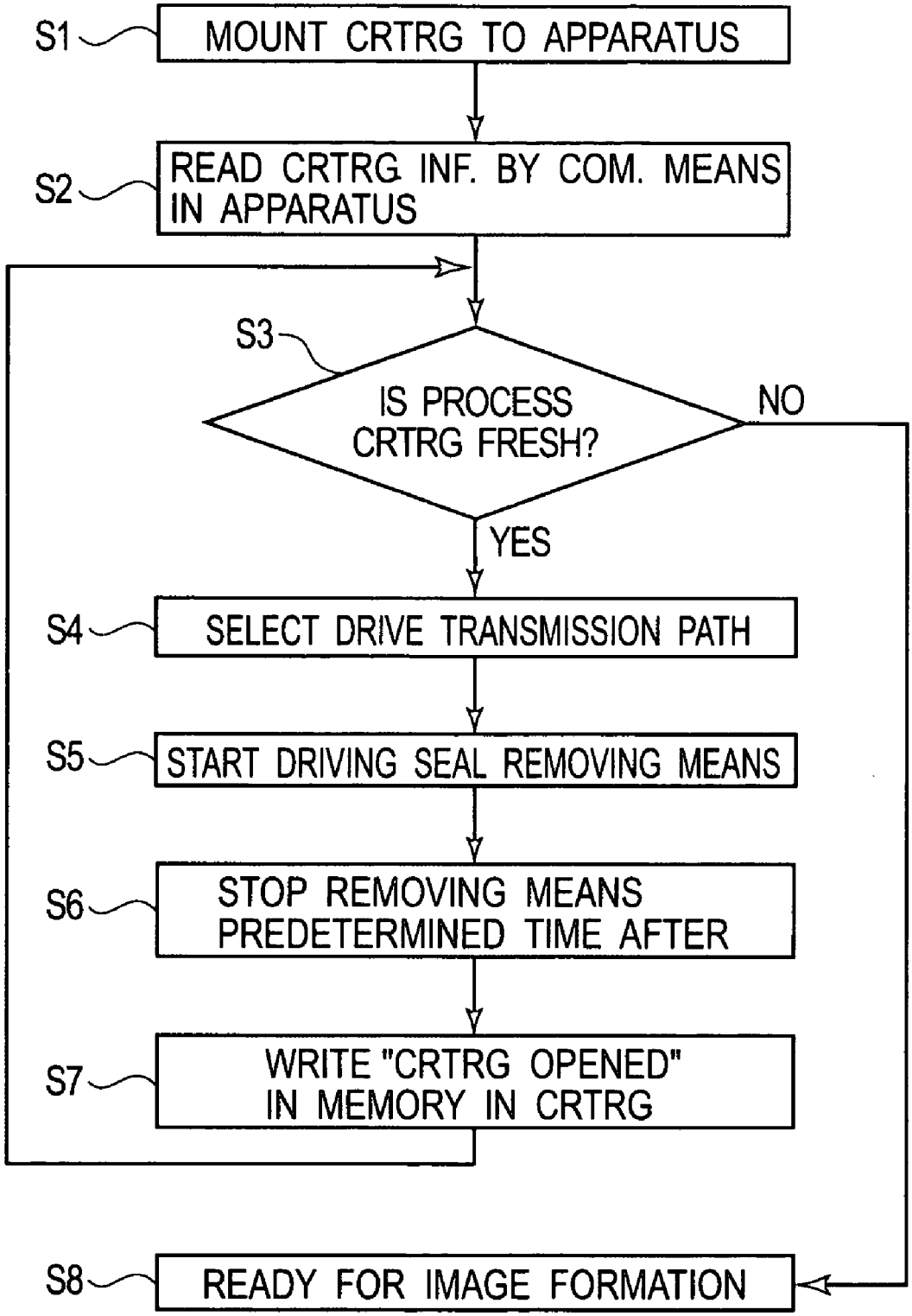
FIG. 7 is the flowchart for the operation, in the first embodiment, for winding up the sealing member.
Figure 8:
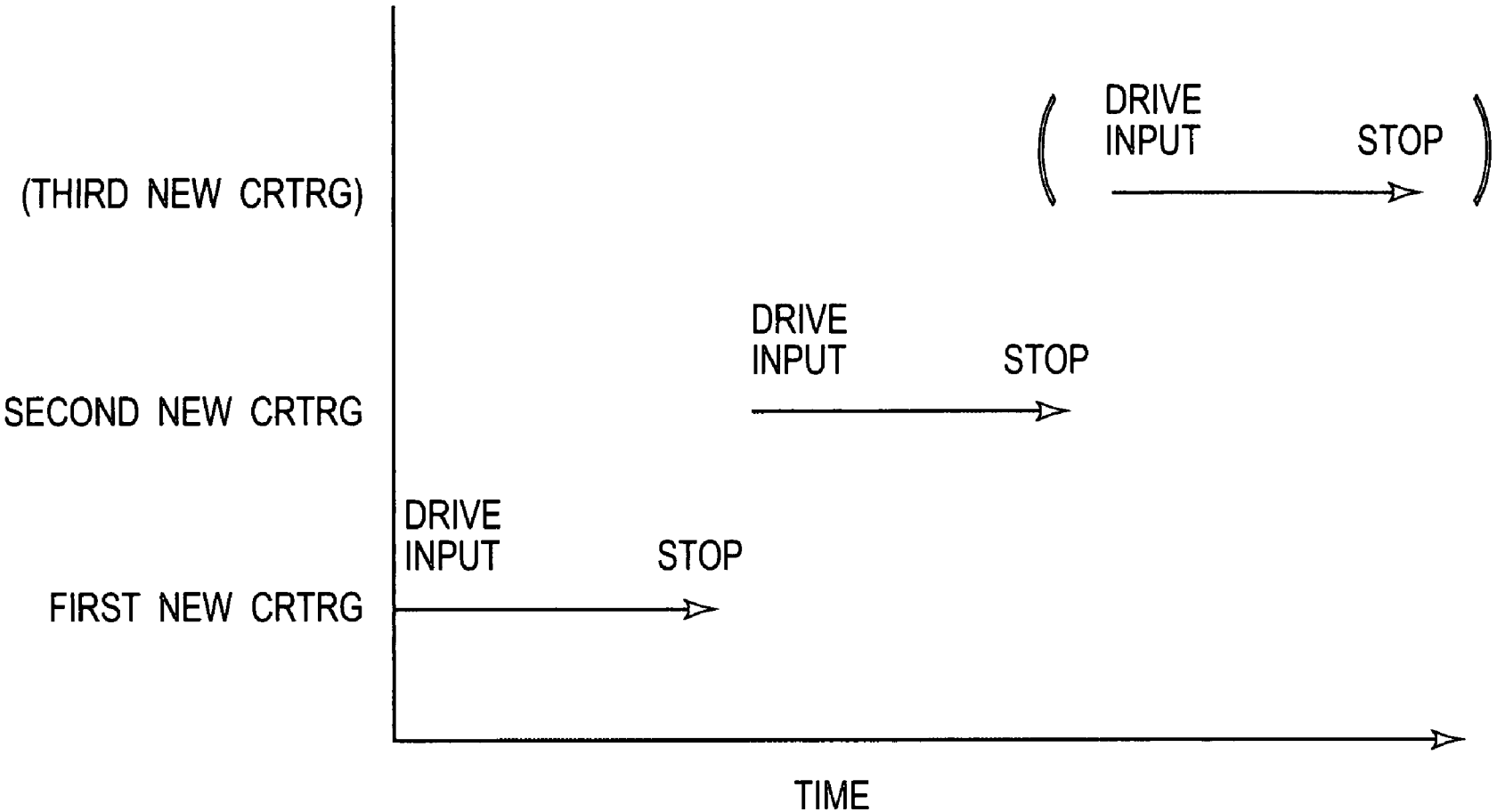
FIG. 8 is a graph of a timetable for the operation, in the first embodiment, for winding up the sealing member.

When two or more of the cartridges 7 are in the brand-new condition, the sequence for removing the toner seal 46 is carried out according to the timetable in FIG. 8, and the flowchart in FIG. 7.

More specifically, first, one of the cartridges 7 (which hereinafter will be referred to as first cartridge 7A) among the two or more cartridges 7 in the brand-new condition is selected (S3–S4). Then, the driving force is transmitted to the toner seal winding shaft 54 of the first cartridge 7A through the toner supply roller 43 of the first cartridge 7A (S5). This transmission of the driving force to the winding shaft 54 is continued until the opening 41*a* of the toner container 41 is completely exposed. As soon as the opening 41*a* of the first cartridge 7A is completely exposed, the transmission of the driving force to the first cartridge 7A is ended (S6). Then, the information that the opening 41*a* of the toner container 41 of the first cartridge 7A has been completely exposed (information that toner container is open) is written into the storage means M of the first cartridge 7A by the reading/writing apparatus RW (S7).

Next, it is determined again whether or not there is another cartridge 7 in the brand-new state (S3). If it is determined that the second cartridge 7B is in the brand-new condition, the driving force is transmitted to the toner seal winding shaft 54 of the second cartridge 7B through the toner supply roller 43 of the second cartridge 7B (S5). This transmission of the driving force to the winding shaft 54 of the cartridge 7B is continued until the opening 41*a* of the toner container 41 is completely exposed. As soon as the opening 41*a* of the toner container 41 of the first cartridge 7A is completely exposed, the transmission of the driving force to the second cartridge 7B is ended (S6). Then, the information that the opening 41*a* of the toner container 41 has been completely exposed (information that toner container is open) is written into the storage means M of the second cartridge 7B by the reading/writing apparatus RW (S7). Next, it is determined again whether or not there is another cartridge 7 in the brand-new state (S3). If it is determined that there is another cartridge 7 in the brand-new condition (third cartridge 7C), the sequence for retracting (removing) the toner seal 46 of the third cartridge 7C is carried out.

The above-described sequence for removing (retracting) the toner seal 46 to completely expose the opening 41*a* of the toner container 41 is carried out one after another until the toner seal 46 is removed from all of the cartridges 7 in the brand-new condition. As soon as the sequences are completed for the cartridges 7, for example, cartridges 7A and 7B, the image forming apparatus 100 is immediately readied for image formation (S8).

At this time, the amount of the torque necessary for removing the toner seal 46 will be described.

The inventors of the present invention measured the amount of the torque required when actually removing the toner seal 46 from a cartridge in accordance with the present invention. The results are given in FIG. 9.

To describe this measurement operation more concretely referring to FIG. 5, the opening 41*a* of the toner container 41 in this embodiment was 21.2 cm in length (L), and 1.1 cm in width (W), whereas the width (W0) of the toner seal 46 was 2.1 cm.

The diameter of the toner seal winding shaft 54 was 7 mm, and the apparent diameter of the combination of the winding shaft 54 and toner seal 46 measured at the end of the winding of the toner seal 46 was 10.6 mm.

The toner seal 46 covering the opening 41*a* having the above-discussed measurements was wound up by the rotating the winding shaft 54 having the above-discussed measurements, at a peripheral velocity of 18.6 mm/sec. Thus, the peripheral velocity of the combination of the winding shaft 54 and the portion of the toner seal 46 wound around the winding shaft 54 was 18.6 mm/sec at the start of the winding, and 28.1 mm at the end of the winding. The time required for complete exposure of the opening 41*a* was roughly 20 seconds in actual time. The amount of the input torque measured at the gear 102 of the main assembly motor, shown in FIG. 3, was 0.2 Nm.

Figure 9:
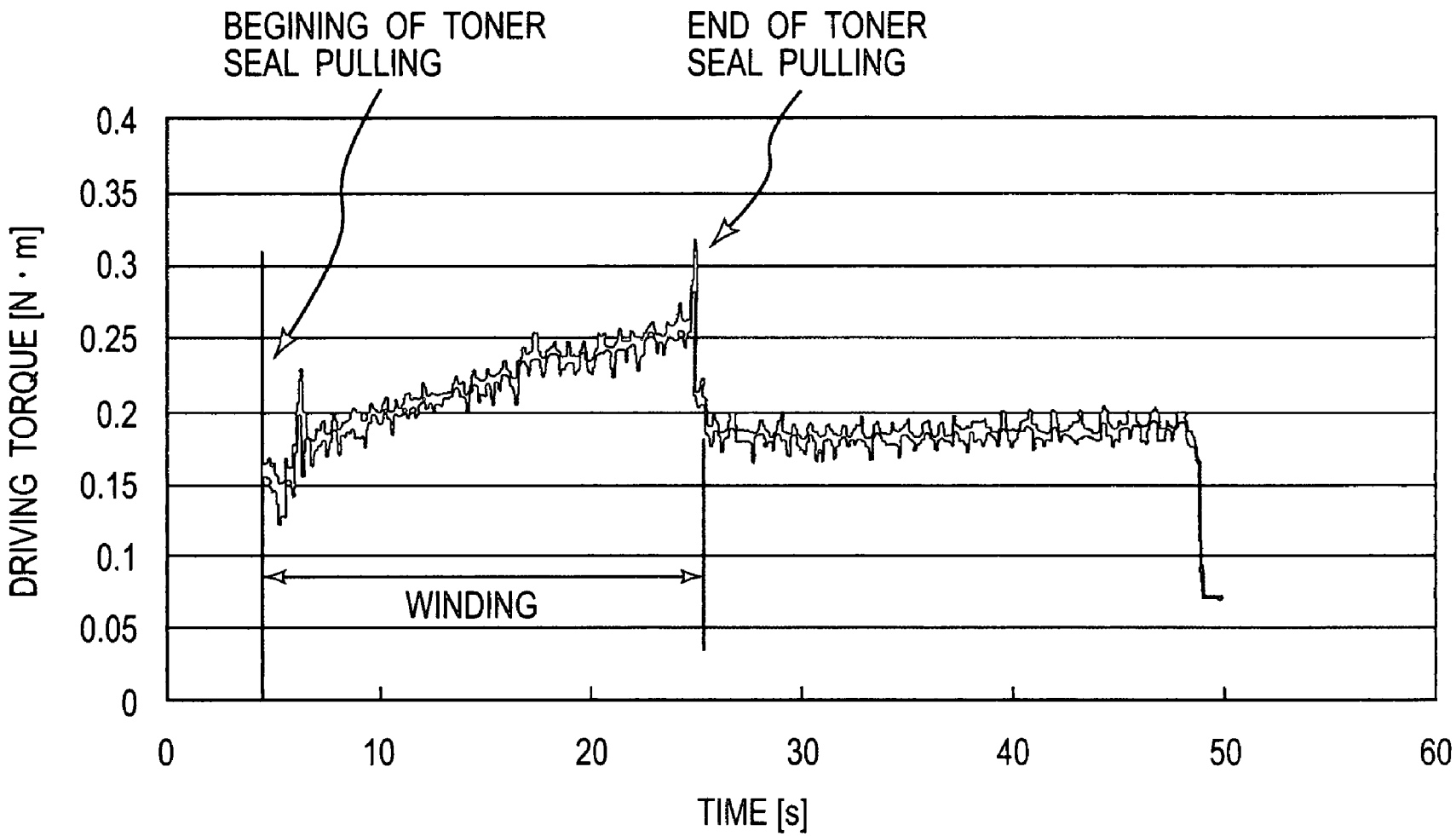
FIG. 9 is a graph showing the relationship between the amount of the torque necessary to move the toner seal, and the length of time required to moving the toner seal, in the first embodiment.
Figure 10:
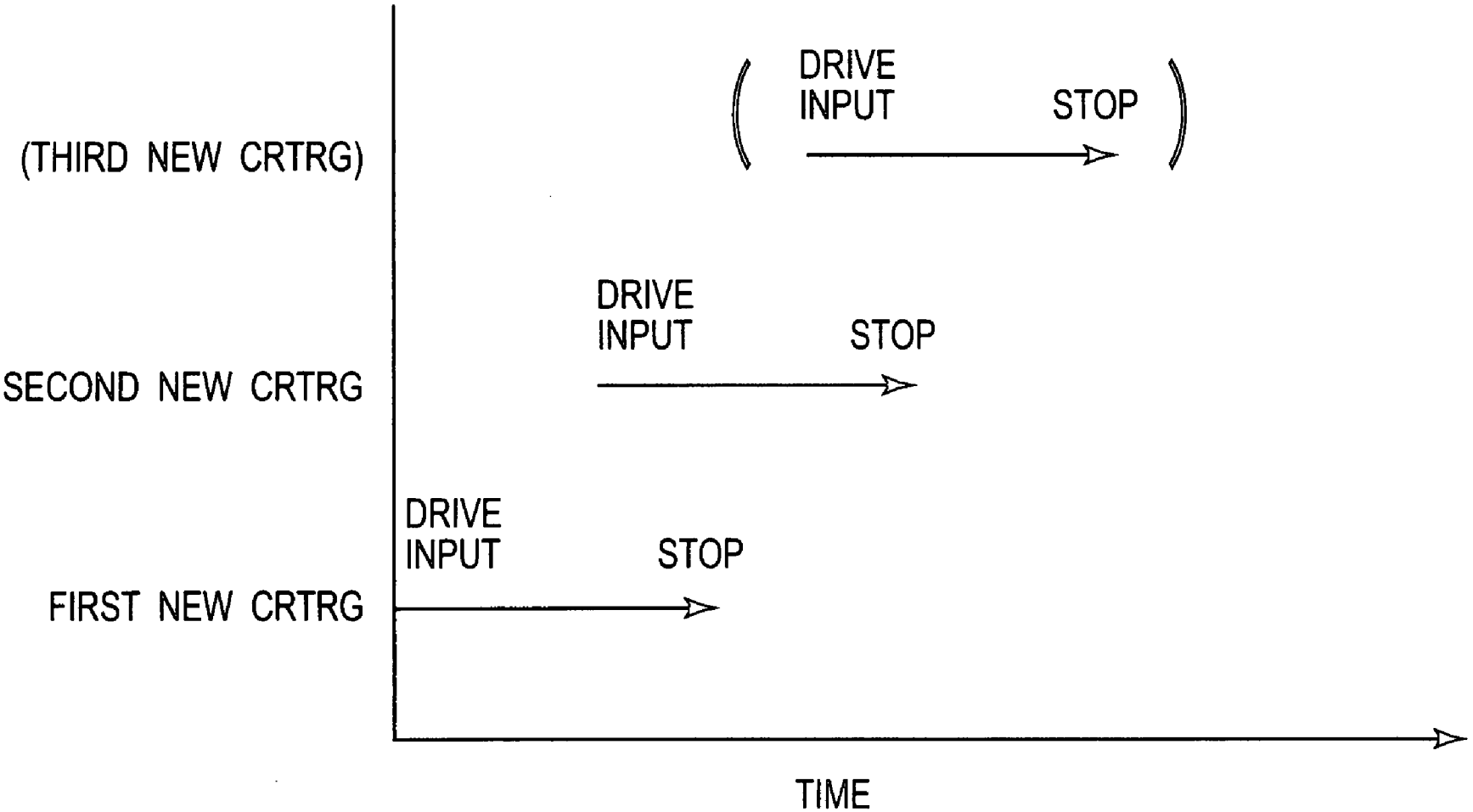
FIG. 10 is a graph of a timetable for the operation, in another embodiment, for winding up the sealing member.
Figure 11:
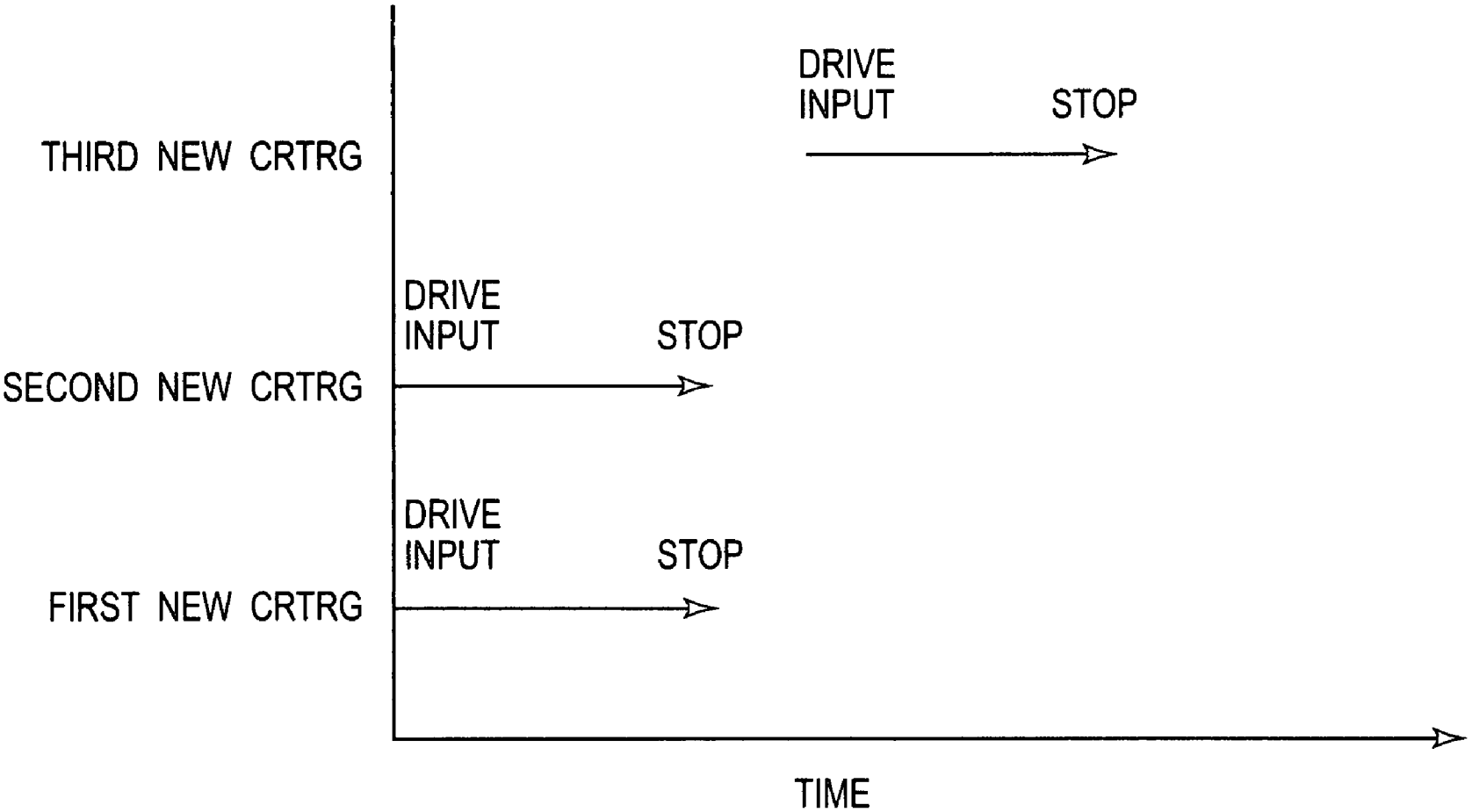
FIG. 11 is a graph of a timetable for the operation, in another embodiment, for winding up the sealing member.

As will be evident from FIG. 9, as the winding of the toner seal 46 continued, the amount of the input torque gradually increased. Further, the amounts of the input torque required at the start and end of the winding were substantially greater than that required during the winding, although the length of time the greater amount of the torque was needed was brief.

This phenomenon occurred for the following reason. That is, the toner seal 46 is attached to the fringe 41*b* of the opening 41*a* of the toner container 41 by welding, gluing, or the like means, in a manner to seal the opening 41*a* of the toner container 41. Therefore, as the toner seal 46 is peeled (wound) in the lengthwise direction of the opening 41*a* of the toner container 41, the start and end of the toner seal winding (peeling) process correspond one for one to the two portions of the fringe of the opening 41*a*, to which the toner seal 46 is attached by a greater length, in terms of the widthwise direction of the opening 41*a*, than the length by which the toner seal 46 is attached to the rest of the fringe of the opening 41*a*. Therefore, when peeling the portions of the toner seal 46 attached to these two portions of the fringe, a greater amount of force, that is, a greater amount of input torque, is required than when peeling the portion of the toner seal 46 attached to the rest of the fringe of the opening 41*a*.

Therefore, if the timing with which the higher amount of input torque needs to be outputted for peeling (removing) the toner seal 46 of one cartridge 7 in the brand-new condition coincides with that for another one in the brand-new condition, the amount of electric power supplied to the driving portion 66 must be increased accordingly.

Figure 12:
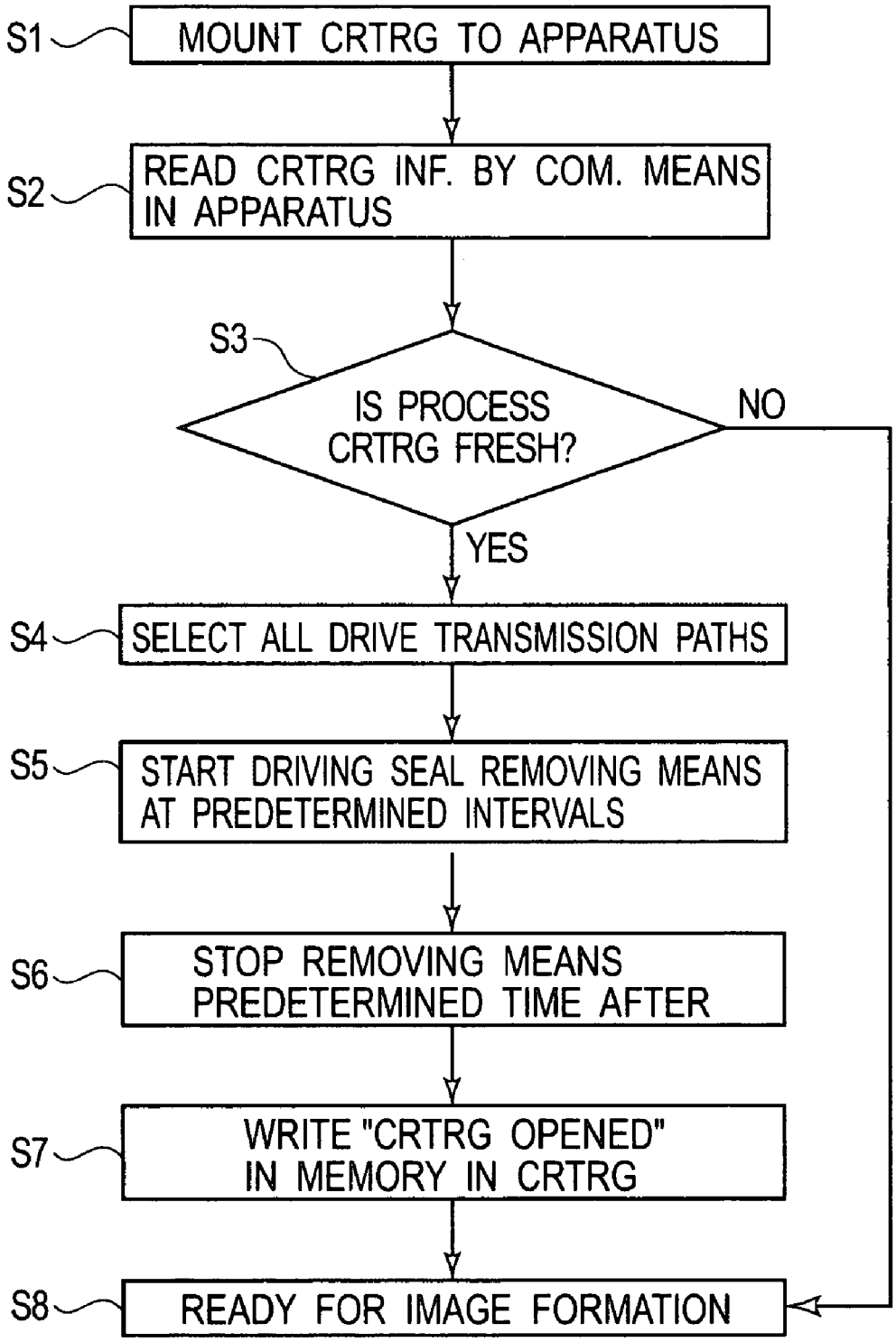
FIG. 12 is the flowchart for the operation, in the first embodiment, for winding up the sealing member.

As a means for avoiding the occurrence of the above-described situation, the following toner seal winding sequence may be employed, instead of the sequence given in FIG. 9. That is, the timing with which the driving force for exposing the opening 41*a* is given to the second cartridge (for example, second cartridge 7B) in terms of the order in which the driving force is to be transmitted to each cartridge 7 is made to be ahead of the timing with which the transmission of the driving force to the first cartridge 7 (for example, first cartridge 7A), in terms of the order in which the driving force is to be transmitted to each cartridge 7, is ended, that is, before the process for exposing the opening 41*a* of the first cartridge 7 is completed. FIG. 12 is the flowchart showing such a driving force transmission sequence.

To describe this process more specifically, all the cartridges 7 in the brand-new condition are identified among all the cartridges 7 in the apparatus main assembly 100*a* (S3–S4). It is assumed here that the first, second, and third cartridges 7A, 7B, and 7C are in the brand-new condition. First, the driving force is transmitted to the toner seal winding shaft 54 of the first cartridge 7A through the toner supply roller 43 of the first cartridge 7A (S5). Then, after the elapse of a predetermined length of time (15 ms in this embodiment) since the starting of the transmission of the driving force to the toner seal winding shaft 54 of the first cartridge 7A, the transmission of the driving force to the toner seal winding shaft 54 of the second cartridge 7B through the toner supply roller 43 of the second cartridge 7B is started (S5). Then, after a predetermined length of time (15 ms in this embodiment) after the starting of the transmission of the driving force to the winding shaft 54 of the second cartridge 7B, the transmission of the driving force to the toner seal winding shaft 54 of the third cartridge 7B through the toner supply roller 43 of the third cartridge 7B is started (S5).

Thereafter, the transmission of the driving force to the toner seal winding shafts 54 is continued until the openings 41*a* of all the cartridges 7 in the brand-new condition are completely exposed (actually, for a predetermined length of time). Then, after the openings 41*a* of all the cartridges 7 in the brand-new condition are completely exposed, the driving of the first, second, and third cartridges 7A, 7B, and 7C is sequentially stopped in the listed order (S6). Next, the information that the openings 41*a* of all the cartridges 7 which was in the brand-new condition have been fully exposed is written into the storage means M by the reading/writing apparatus RW (S7). This information may be sequentially written for each cartridge 7, or all at once for all the cartridges 7.

Embodiment 2

Next, another method, in accordance with the present invention, for winding up the sealing member of the cartridge 7, in an image forming apparatus, will be described.

Figure 6:
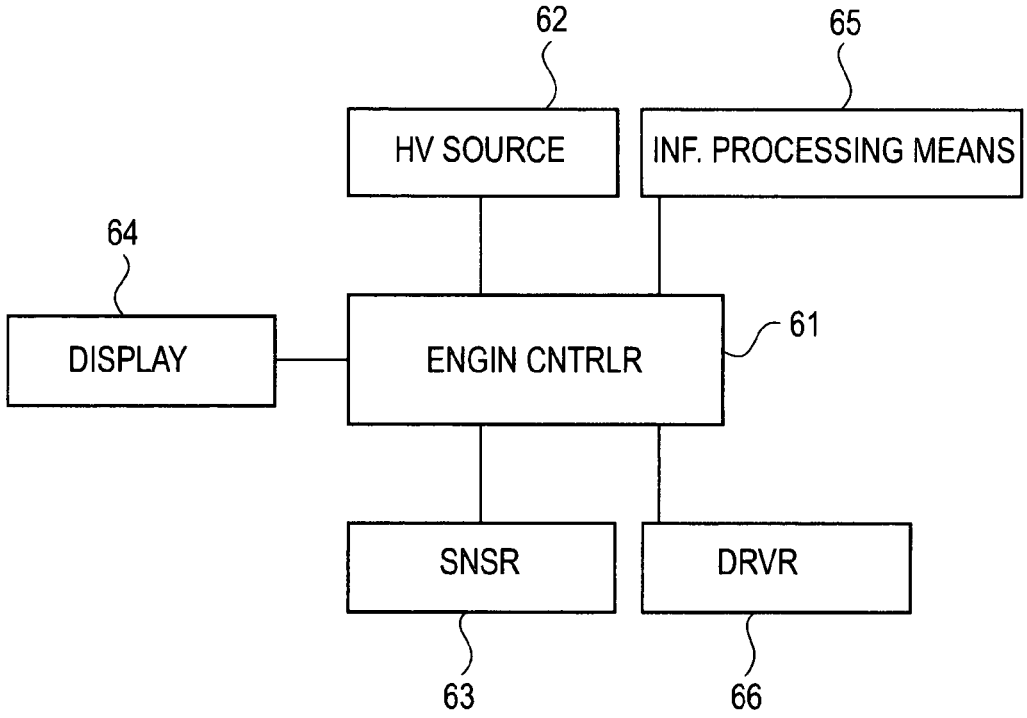
FIG. 6 is a schematic block diagram showing the configuration of the main assembly of the image forming apparatus in the first embodiment.

Also in this embodiment, the image forming apparatus 100 and cartridge 7, in the first embodiment, described with reference to FIGS. 1–5, and the operational system of the image forming apparatus, in the first embodiment, described with reference to FIG. 6, are used. Therefore, the descriptions of the image forming apparatus 100, the cartridge 7, and the operational system therefor, in the first embodiment, will be substituted for the descriptions of those in the second embodiment, and only the sealing member retraction (removal) sequence, in this embodiment, which characterizes this embodiment, will be described.

(Sealing Member Retraction Sequence)

The driving means D in this embodiment is the same as the driving means D in the first embodiment shown in FIG. 3.

In other words, as it is recognized by the information processing means 65 of the image forming apparatus main assembly 100*a*, based on the information in the storage means M of the cartridge 7 having just been mounted in the apparatus main assembly 100*a*, that the cartridge 7 having just been mounted into the image forming apparatus 100*a* is in the brand-new condition, the aforementioned engine controller 61 begins to control the apparatus main assembly 100*a* so that the driving force is transmitted from the motor 101 to the cartridge 7 to expose the opening 41*a* of the toner container 41.

The driving force from the motor 101 of the image forming apparatus main assembly 100*a* is transmitted through a gear train to a clutch CL104, for example, an electromagnetic clutch, as it is in the first embodiment, so that the driving force is transmitted downstream to the downstream gear train and the cartridge 7, or the driving force is not transmitted downstream, that is, the motor 100 is idled.

With the provision of the above-described mechanical arrangement, the opening 41*a* of the toner container 41 is automatically exposed as the driving force from the motor 101 of the image forming apparatus main assembly 100*a* is transmitted to the cartridge 7.

In particular, with the provision of the storage means M, the information processing means 65, and the clutch CL, it is assured that after the mounting of two or more cartridges 7 into the apparatus main assembly 100*a*, the driving force from the motor 101 is transmitted to the developing means container side of only the cartridge 7 in the brand-new condition.

Also in this embodiment, the transmission of the driving force is controlled according to the flowchart in FIG. 7, as it is in the first embodiment, so that the driving force is selectively transmitted to the cartridges 7 having just been mounted in the image forming apparatus main assembly 100*a*; it is transmitted only to the cartridges 7 in the brand-new condition. The manner in which the driving force is transmitted to the cartridge 7 is the same as that in the first embodiment, and therefore, will not be described here.

This embodiment is different from the first embodiment, only in the manner in which the transmission of the driving force to the cartridges 7 is controlled when two or more cartridges 7 mounted in the apparatus main assembly 100*a* are in the brand-new condition.

Figure 13:
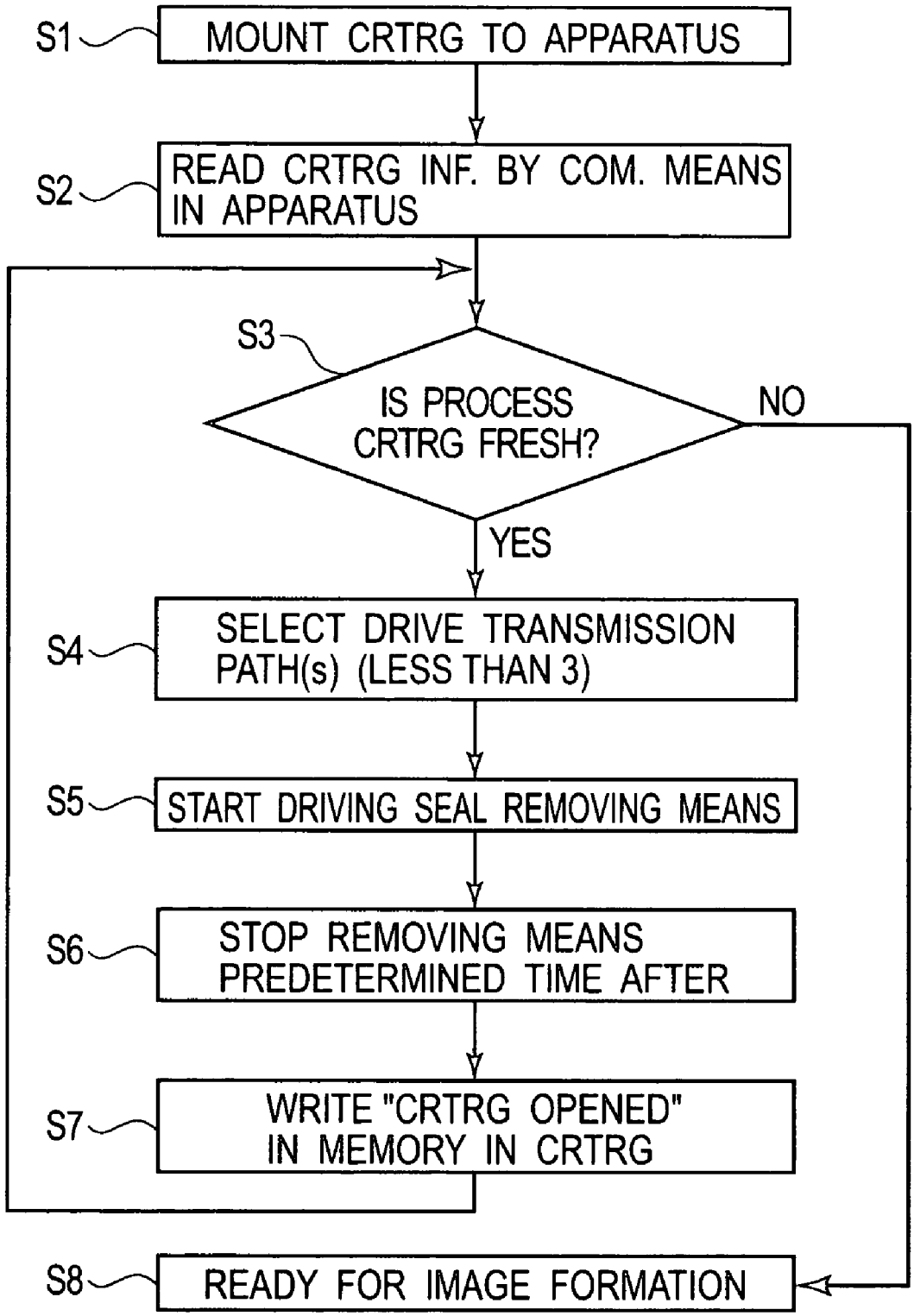
FIG. 13 is the flowchart for the operation, in the second embodiment, for winding up the sealing member.

That is, in this embodiment, the control is executed according to the flowchart in FIG. 7 in order to assure that after the insertion of two or more cartridges 7, the driving force is transmitted only to those in the brand-new condition. In this embodiment, however, when two or more cartridges 7 are in the brand-new condition, the transmission of the driving force is controlled according to the timetable in FIG. 11, and the flowchart in FIG. 13.

More specifically the process, in this embodiment, for identifying a cartridge 7 in the brand-new condition identifies only up to two cartridges 7 in the brand-new condition (S4). Then, the driving force is simultaneously transmitted to up to two cartridges 7 (first and second cartridges 7A and 7B) identified as the cartridges in the brand-new condition, from the image forming apparatus main assembly 100*a*; for example, the driving force is transmitted to the toner seal winding shafts 54 of the first and second cartridges 7A and 7B (or cartridge 7A if the cartridge 7A is the only one in the brand-new condition) through the toner supply rollers 43 of the first and second cartridges 7A and 7B (S5). The transmission of the driving force is continued until the opening 41*a* of the toner container of each of the two cartridges 7 is completely exposed. The transmission of the driving force to the first cartridge 7A and second cartridge 7B is stopped as soon as the openings 41*a* of the first and second cartridges 7A and 7B are fully exposed (S6). Then, the information that the opening 41*a* of each of the first and second cartridges 7A and 7B is completely exposed (toner container is fully open) is written into the storage means M by the reading/writing apparatus RW (S7).

Then, it is checked again whether or not there are more cartridges 7 in the brand-new condition, in the image forming apparatus main assembly 100*a* (S3). If is determined that another cartridge (third cartridge 7C) is in the brand-new condition, the driving force is transmitted to the winding shaft 54 of the third cartridge 7C through the toner supply roller 43 of the third cartridge 7C (S5). The transmission of the driving force to the winding shaft 54 of the third cartridge 7C is continued until the opening 41*a* of the toner container 41 of the third cartridge 7C becomes fully exposed, and then, is stopped as soon as the opening 41*a* of the third cartridge 7C becomes fully exposed (S6). Next, the information that the opening 41*a* of the toner container 41 of the third cartridge 7C is completely exposed (toner cartridge is fully open) is written into the storage means M by the reading/writing apparatus RW (S8).

In other words, if the amount of electric power afforded to the driving portion 66 by the power source is large enough to transmit the driving force to the two cartridges 7A and 7B at the same time, the above-described driving force transmission sequence can be employed.

The preceding embodiments were described with reference to the electrophotographic image forming apparatus 100 of an inline type. However, the application of the present invention is not limited to an electrophotographic image forming apparatus of an inline type. For example, the present invention is also applicable to an image forming apparatus equipped with a developing apparatus comprising a rotary unit in which two or more development units are removably mountable, and such an application brings forth the same effects as those described above.

As described above, according to one of the characteristic aspects of the present invention, the sealing member keeping sealed the opening of the developer outlet of the toner container of a process cartridge is automatically and reliably moved to fully expose the opening.

According to another characteristic aspect of the present invention, the information that the opening of the developer outlet of the developer storage portion of a process cartridge is sealed with a sealing member is stored in the memory with which the process cartridge is provided. Therefore, the driving force from the main assembly of an image forming apparatus can be transmitted only to the cartridges selected based on the information stored in the memory in each of the cartridges, to unseal the opening of the developer outlet of each of the selected cartridges.

According to another characteristic aspect of the present invention, only simple control is required to expose the aforementioned opening by automatically moving the aforementioned sealing member.

According to another characteristic aspect of the present invention, the driving force from the apparatus main assembly is transmitted only to the development units, the opening of the developer outlet of the toner container of which is sealed, or the process cartridges having such a development unit. Therefore, power consumption is minimized.

According to another characteristic aspect of the present invention, the driving force from the apparatus main assembly is transmitted only to the development units, the opening of the developer outlet of the toner container of which is sealed, or the process cartridges having such a development unit. Therefore, the service life of a development unit, or a process cartridge, is prevented from being reduced by the unnecessary transmission of the driving force thereto.

According to another characteristic aspect of the present invention, the sealing member for keeping sealed the opening of the developer outlet of the developer storage portion of a process cartridge can be automatically moved to expose the opening, without the need for directly detecting the state of the sealing member.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 308094/2003 and 241640/2004 filed Aug. 29, 2003 and Aug. 20, 2004, respectively which are hereby incorporated by reference.

What is claimed is:

1. An electrophotographic image forming apparatus to which a plurality of process cartridges are detachably mountable, said apparatus comprising:

(i) a driving source;

(ii) mounting means for demountably mounting process cartridges, the process cartridges each including a developing member configured and positioned to develop an electrostatic latent image formed on an electrophotographic photosensitive member, a developer accommodating portion configured to accommodate a developer to be used by the developing member, the developer accommodating portion having a supply opening for supplying the developer to the developing member, a sealing member movable between a sealing position in which the supply opening is sealed and an unsealing position in which the supply opening is unsealed, and a sealing member moving means for moving the sealing member from the sealing position to the unsealing position to unseal the supply opening by receiving a driving force transmitted from said driving source; and (iii) a belt member movable to contact the electrophotographic photosensitive members of all of said process cartridges; and (iv) control means for transmitting the driving force to the sealing member moving means of only the process cartridge for which the sealing position of the sealing member is detected to move the sealing member from the sealing position to the unsealing position, when the plurality of process cartridges are mounted to said apparatus, wherein when said control means detects that sealing members of a plurality of the process cartridges are at the sealing position upon mounting of the plurality of process cartridges to said apparatus, said control means starts unsealing movements of the sealing members with time lags by transmitting the driving forces to the sealing member moving means with time lags.

2. An apparatus according to claim 1, wherein said control means detects information relating to sealing stored in memory means provided in the process cartridges, wherein the information is indicative of a state that the supply opening is sealed by the sealing member.

3. An apparatus according to claim 1, wherein said driving source comprises motors which drive the process cartridges independently of each other.

* * * * *

UNITED STATES PATENT AND TRADEMARK OFFICE

CERTIFICATE OF CORRECTION

PATENT NO. : 7,231,164 B2
APPLICATION NO. : 10/924771
DATED : June 12, 2007
INVENTOR(S) : Kinya Harada et al.

It is certified that error appears in the above-identified patent and that said Letters Patent is hereby corrected as shown below:

COLUMN 2:
Line 27, “provide” should read --to provide--.

COLUMN 3:
Line 48, “demountable” should read --demountably--.

COLUMN 6:
Line 35, “means” should read --means (FIG. 3).--.
Line 36, delete line 36.
Line 37, delete line 37.

COLUMN 9:
Line 12, “one the” should read --one of the--.

COLUMN 16:
Line 51, “the rotat-” should read --rotation--.
Line 52, “ing” should read --of--.

Signed and Sealed this

Third Day of February, 2009

JOHN DOLL
*Acting Director of the United States Patent and Trademark Office*